US010278426B2

(12) United States Patent
Gadas

(10) Patent No.: US 10,278,426 B2
(45) Date of Patent: May 7, 2019

(54) MODULAR VAPORIZER

(71) Applicant: Alexander Gadas, Brooklyn, NY (US)

(72) Inventor: Alexander Gadas, Brooklyn, NY (US)

( * ) Notice: Subject to any disclaimer, the term of this patent is extended or adjusted under 35 U.S.C. 154(b) by 0 days.

(21) Appl. No.: 15/431,080

(22) Filed: Feb. 13, 2017

(65) Prior Publication Data

US 2017/0231283 A1 Aug. 17, 2017

Related U.S. Application Data

(60) Provisional application No. 62/294,520, filed on Feb. 12, 2016, provisional application No. 62/338,759, filed on May 19, 2016, provisional application No. 62/418,902, filed on Nov. 8, 2016.

(51) Int. Cl.

| | |
|---|---|
| ***A24F 47/00*** | (2006.01) |
| ***A24F 7/02*** | (2006.01) |
| ***H05B 3/26*** | (2006.01) |

(52) U.S. Cl.

CPC ..... *A24F 47/008* (2013.01); *A24F 7/02* (2013.01); *H05B 3/265* (2013.01); *H05B 2203/013* (2013.01); *H05B 2203/024* (2013.01); *H05B 2214/04* (2013.01)

(58) Field of Classification Search

CPC ..... A24F 47/008; A61M 11/041

See application file for complete search history.

(56) References Cited

U.S. PATENT DOCUMENTS

| | | | | |
|---|---|---|---|---|
| 6,037,574 | A * | 3/2000 | Lanham | H05B 3/28 219/390 |
| 2012/0255546 | A1* | 10/2012 | Goetz | A61M 11/041 128/202.21 |
| 2013/0298905 | A1* | 11/2013 | Levin | A24F 47/008 128/202.21 |

* cited by examiner

*Primary Examiner* — Xuong M Chung Trans

(74) *Attorney, Agent, or Firm* — Wiggin and Dana LLP; Joseph M. Casino; Andrew D. Bochner

(57) ABSTRACT

A vaporizer with a modular body design is disclosed. The vaporizer may include an atomizer with a bowl and a heating element. The heating element may be formed of glass. The vaporizer may be formed with an open architecture, such that various components may be interchangeably removed or modified. The vaporizer may be modified with different airways, batteries, atomizers or other suitable devices. The vaporizer may be formed with a slim profile to fit unobtrusively into a pocket.

14 Claims, 27 Drawing Sheets

MODULAR VAPORIZER

CROSS-REFERENCE TO RELATED APPLICATIONS

This application claims priority to U.S. Application No. 62/418,902, filed Nov. 8, 2016 and entitled "Modular Vaporizer," U.S. Application No. 62/338,759, filed May 19, 2016 and entitled "Heating methods for Vaporizers using glass," and U.S. Application No. 62/294,520, filed Feb. 12, 2016 and entitled "Vaporizer." The contents of these applications are incorporated herein by reference in their entirety.

FIELD OF THE DISCLOSURE

The subject matter of the present disclosure relates to a vaporizer, and more particularly, to a vaporizer with a modular design.

BACKGROUND OF THE DISCLOSURE

Current vaporizers may be used with a variety of materials, such as e-liquid, extracts, oil concentrates, loose-leaf or dry-herb. However, use of each different material requires a separate vaporizer, as the vaporizers are not interchangeable among various materials.

Vaporizers are used for aerosolizing or vaporizing an active ingredient within plant matter, such as *cannabis*, tobacco or other herb blends, and or aerosolizing/vaporizing the concentrates of the active ingredients, such as tobacco or medical *cannabis* oils like THC or CBD.

Vaporization and aerosolizing of the active ingredients is performed by heating the plant matter or concentrate to the point of where the active ingredients boil, evaporate, or vaporize without combusting the plant matter or concentrates, which some consider to be a better alternative to smoking. By avoiding combustion of the plant matter/oil, a user does not inhale harmful byproducts produced from smoking (e.g. tar, carcinogens, etc.). Furthermore, vaporizing is considered to be a more efficient material delivery method, as opposed to other methods, such as ingestion.

Vaporizers currently come in shapes approximating a cigarette or cigar, but larger. They are clunky with little thought to the shape, including the portability of the shape. There is not vaporizer that can easily fit in ones pocket in an non-obtrusive matter. Sophisticated design changes are necessary to create a slim profile, credit card shaped vaporizer that can fit into a wallet or non-obtrusively slim into a pocket.

Common types of currently used vaporizers include wax, oil-concentrate vaporizers and dry-herb/loose-leaf vaporizers. The vaporizers may utilize one of two heating methods: conduction heating or convection heating. Conduction heating methods may be used in both wax/oil-concentrate vaporizers and dry-herb/loose-leaf vaporizers. For oil concentrates, conduction heating includes a resistive metal coil is typically used to heat up the oils by applying the oils directly to the coil heating element. For dry herb vaporizers, the heating method includes filling a metal bowl or container with an herb, and then using an exterior heating element for heating.

In convection heating, primarily for dry-herb or loose-leaf materials, air is heated before flowing through the herb, using a resistive material coil. When the hot air flows through the dry-herb/loose-leaf, it causes the active ingredients to vaporize without combusting the herb or plant matter. However, such current vaporizers, whether utilizing convection or conduction heating, are not adaptable to different user designs and preferences. Specifically, current vaporizers do not allow for a user to interchange or modify heating methods for different materials. Instead, a user is required to purchase alternative vaporizers for each desired modification.

It would be desirable, therefore, to provide a vaporizer with a modular design, such that one vaporizer may be used with different types of materials. It would be further desirable for the modular vaporizer to provide for user customization, such as the ability to include add-on accessories or modify certain features of the vaporizer. It would be yet further desirable for the modular vaporizer to provide systems and method for interchangeable heating preferences.

Current vaporizers also tend to cause impurities, which are then inhaled when used. These impurities can be caused by the device itself, as well as by the heating elements used in traditional vaporizer devices, particularly metal heating elements. It would be desirable, therefore, to provide an all-glass heating element, reducing and/or eliminating impurities caused by metals, improving flavor and increasing the purity of vapor. It would be further desirable to provide an all-glass heating element that eliminates contact between metals or harmful materials and vaporized materials, such as liquids, oils or herbs.

In accordance with the invention as set forth below, a flattened, thin and optionally modular vaporizer is provided.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The invention, as disclosed herein, is directed to a vaporizer formed of a modular body design. The design of the vaporizer is specifically formed to provide for an open architecture, allowing for future improvements, attachments and modifications. As disclosed herein, the modular vaporizer may be modified with different atomizers, heating elements, utility functions, batteries, airways and various other attachments. It also is the first to realize a slim profile design that is flattened so that it can slip into a wallet or pocket without being intrusive.

Figure 1:
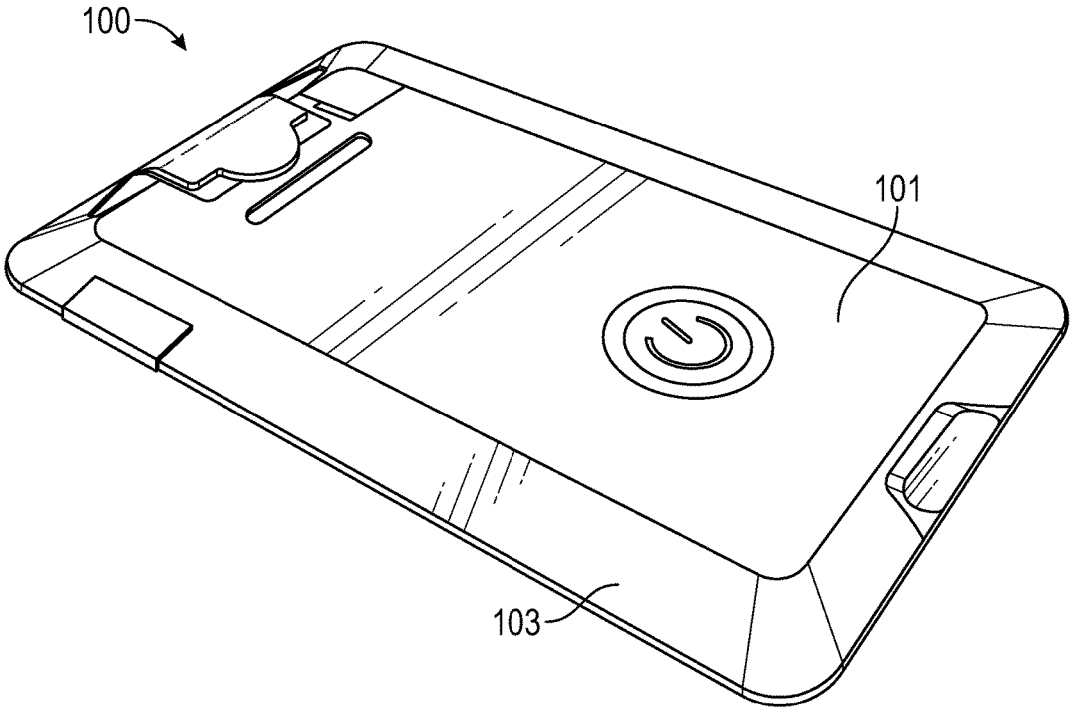
FIGS. 1-5 display various views of a vaporizer in accordance with the invention.

Referring now to FIG. 1, shown is one embodiment of the vaporizer 100. The vaporizer may include, or may be utilized with, any suitable number of attachments. As illustrated, the vaporizer 100 may include a flat smooth top 101, with sloping beveled edges 103. The vaporizer 100 may be formed or utilized with an atomizer, an airway/mouthpiece, and a battery pack. It should be noted that all or some of these components may be removable, or alternatively, may be integrated into the vaporizer.

Figure 2A:
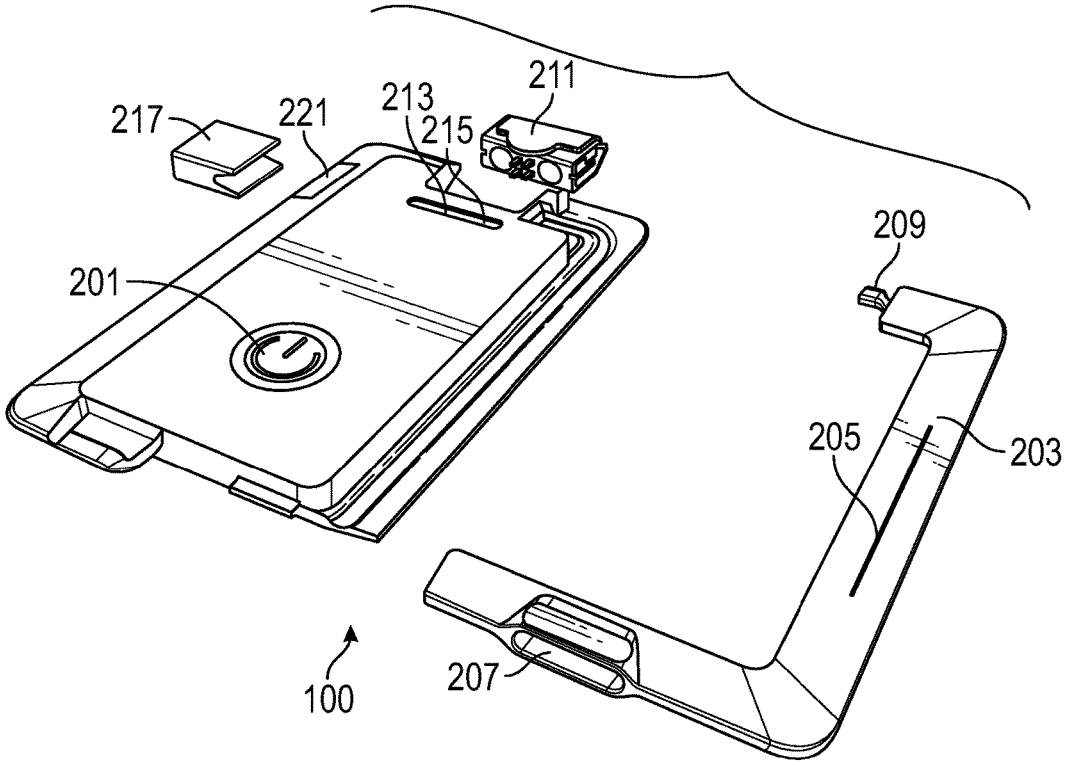

FIG. 2A illustrates the various components of vaporizer 100, including power switch 201, airway module 203, atomizer 211, charger attachment 217, charging mechanism 219, and battery pack 221. Some or all of these components may be attachable in a modular and easily removable manner, such as by magnetic force.

In order to operate the vaporizer 100, it is powered on (and off) using any suitable power switch, such as power switch 201. Power switch 201 is a power button, and may include a touch sensor and/or provide tactile feedback. Power switch 201 may eliminate accidental activation through a combination of a touch sensor and a clickable button. In an embodiment, a user can navigate through a variety of settings associated with the vaporizer 100 by tapping or clicking the smart button. In an embodiment, the button of power switch 201 may combine the satisfaction and feedback of a physical clickable button with the functionality and versatility of a touch sensor, such as a capacitive sensor. However, it should be noted that any suitable power switch, such as a simple mechanical on-off toggle switch, is contemplated.

Airway module 203 provides an airway and mouthpiece for utilizing the vaporizer 100. Airway module 203 may be formed in various shapes and sizes. Airway module may be removable, cleanable and replaceable by the user. In an embodiment, the modular design of the airway 203 allows for a user to choose between different airway sizes, such as, for example, three different airway sizes, each providing a distinctively different draw resistance, which allows a user to customize the vaporizer 100 in accordance with the user's preference. For example, in order to produce different draw resistances, varying shapes or sizes may be chosen. Thus, the resistance of draw may be based on the diameter of the pipe. In one embodiment, the diameter may range from 1.5 mm-4 mm, with 1.5 mm corresponding to a very restricted draw, and 4 mm corresponding to a very free-flowing draw.

In one embodiment, airway module 203 may be formed to include a storage space for a dab tool or dabber. In another embodiment, the airway module 203 is extendable. For example, the airway module 203 may include a telescoping interior tube that collapses or extends when needed. In yet another embodiment, the airway module 203 is formed such that it conforms to the shape of the vaporizer 100, minimizing the form factor of vaporizer 100. In this embodiment, for example, the airway module may 203 may bend along its length.

Airway module 203 is specifically formed in consideration of the modular nature of vaporizer 100. Thus, airway module 203 may be wholly removable from the body of vaporizer 100, allowing for an individual to interchange the module 203 for different airways of varying sizes and draws, if desired.

As illustrated in FIG. 2, airway module 203 may be formed around the outer frame or rim of the vaporizer 100. In one embodiment, airway module 203 is formed of a unitary piece. In another embodiment, airway module 203 is formed of several attachable pieces. The modular and removable nature of airway module 203 provides for easy replacement and cleaning of airway or its components.

Airway module 203 further includes an interior tube 205 within the casing of the airway module. In one embodiment, interior tube 205 may be an additional hollow tube or pipe disposed within the body of airway module 203. Thus, in accordance with this embodiment, interior tube 205 may itself be removable for easy cleaning and replacement. Interior tube 205 may be removable, and may be provided in various draw resistances. For example, to adjust draw resistance, interior tube 205 may be available in any suitable diameter between 1.5 mm-4 mm.

Alternatively, interior tube 205 may be the interior hollow length formed from the body of airway module 203. Interior tube 205 connects mouthpiece 207 at a first terminus of the airway module 203/interior tube 205 to an exit port 209 at a second terminus of the module 203/interior tube 205. In turn, exit port 209 may plug into atomizer 211. Interior tube 205 may magnetically attach to the body, while exit port 209 clicks into and attaches to airway module 203. The mouthpiece 207 may be a modular component and separately removable from all other components, allowing for easy cleaning and replacement. For example, mouthpiece 207 may be replaced with alternative mouthpieces of various shapes and sizes, in order to adjust the draw of the vapor. In another embodiment, the mouthpiece 207, interior tube 205 and exit port 209 are formed of one unitary piece. Exit port 209 plugs into atomizer 211, where vapor is produced, and is the entry of the vapor into the airway module 203. From the exit port, 209, the vapor continues through interior 205 and exits at the mouthpiece 207, where the user inhales the vapor.

Atomizer 211 is modular and removable from vaporizer 100. It should be noted that atomizer 211 may be a port plugin, such as shown in FIG. 2A. Atomizer 211 may be formed in different shapes and sizes, with varying capacities. In one embodiment, the atomizer is formed as a small atomizer, such that it is flush with the body of the vaporizer 100. In another embodiment, the atomizer is formed of medium size, such that it is slightly protruding from the body of the vaporizer 100. In yet another embodiment, the atomizer is formed of a large size, with a substantial protrusion from the body of the vaporizer 100.

Atomizer 211 is formed from a bowl and a heating element (not shown). The bowl may be formed of a ceramic or ceramic-like material, metal, non-electric material, a classic pipe bowl, or any other suitable material. Atomizer is specifically formed to receive an extract, flower or any other suitable material or substance.

On the outside of the ceramic bowl, silicone, such as heat-resistant silicone, may provide a material for protecting and insulating the atomizer. In another embodiment, other insulation materials may be used in addition to, or as a replacement for, silicone, including highly porous fibrous materials, which may form a thin layer of the ceramic bowl. The thin layer may then quickly dissipate heat, and provide a thin barrier from the bowl. In another embodiment, gel-type materials, such as aero-gel, may be used.

It should be noted that, as disclosed herein, different types or sizes of atomizers may be used for different vaporizable or burnable substances, such as wax, liquid, oil, extracts, dry herb or any other suitable substance. For example, in one embodiment, vaporizer 100 may include an atomizer module 211 suitable for use with solid or high viscosity extracts, including, but not limited to, a dual coil with quartz rods, stainless steel mesh, ceramic, honey-comb ceramic, glass, and/or gold-plated glass heating elements. In another embodiment, vaporizer 100 may include an atomizer for use with loose-leaf, dry-herb or flowers, including conduction or convection atomizers.

In an embodiment, vaporizer 100 is formed to be used with a pre-filled cartridge. The pre-filled cartridge may take the place of atomizer 211, sliding into the atomizer port. The cartridge may be a basic cartridge with a reservoir, wicking material, and a heating element. The cartridge may be filled with e-liquid and/or a low-viscosity extract. In one embodiment, e-liquid may be a vegetable glycerin-based flavored liquid, used for vaporizing.

Precise temperature control mechanism 213 allows for the vaporizer 100 to determine, with specificity, the temperature of the various processes utilized. Temperature control mechanism 213 may be placed at any suitable location on vaporizer 100, and may include one or more light emitting diodes (LEDs) 215 as well as a temperature sensor (not shown). The LEDs 215 may be displayed at varying levels of brightness, or in varying colors, to correspond to a chosen or specified temperature. For example, a green LED 215 may indicate a first temperature, whereas a yellow LED 215 may indicate a second temperature. In another example, the LED 215 may be displayed with three out of five lights displayed for a third temperature, whereas the LED 215 may display four out of five lights for a fourth temperature. In one embodiment, the temperature control mechanism 213 may be operable with one, two, three, four, five, six, seven, eight or more temperatures that may be selected. Control of the temperature may be performed using a mechanism such as a circuit board.

The charging mechanism 217 of the vaporizer 100 provides for as a USB-coupled charging piece. In one embodiment, charging mechanism 217 may be magnetic, and allow for magnetically coupling a USB charging cord to the vaporizer 100. In another embodiment, charging mechanism 217 may be a charger attachment for magnetically receiving a magnetic micro-USB port and attaching to magnetic strip 221.

Figure 2B:
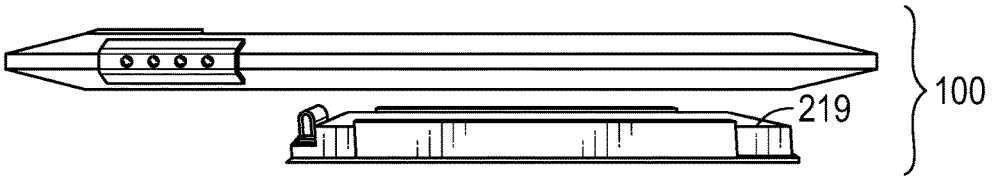

Vaporizer 100 further includes battery pack 219, shown in FIG. 2B. Battery pack 219 may be removable and/or replaceable. Battery pack 219 may be interchangeably removed and replaced with different capacities. In one embodiment, a small capacity battery, such as one with a capacity of 450 Milliamp hours (mAh), or a similarly suitable capacity, may be used. Use of a small battery capacity would allow for a smaller profile size for the battery, such that it can be placed flush with the body of the vaporizer. In another embodiment, a medium capacity battery, such as one with a capacity of 750 mAh, or a similarly suitable capacity, may be used. A battery of medium size would protrude slightly from the body of the vaporizer. In yet another embodiment, a large capacity battery, such as one with a capacity of 1100 mAh or greater, may be used. The size of this battery would cause a substantial protrusion to be formed from the body of the vaporizer.

Exemplary battery packs that may be utilized with the vaporizer include, but are not limited to, a wireless charging Qi battery pack, in conformance with the Wireless Power Consortium charging standard, solar charging battery, or a battery pack with container feature for storing extra material.

Magnetic strip 221 is provided for charging of the battery pack 219. Magnetic strip 221 is configured to magnetically attach to, and form an electrical connection with, charger attachment 217. In one embodiment, charger attachment 217 may include one or more metal prongs or magnets on a grooved side of the attachment, which secures attachment 217 to magnetic strip 221. This allows the device to charge.

The vaporizer may 100 be utilized with any suitable number or variety of attachments, in particular due to its modular nature. Exemplary utility attachments include a flashlight, herb grinder attachment, electronic cigarette lighter, or a utility tool, such as a miniaturized screwdriver.

In an embodiment, the vaporizer may include, or be associated with, one or more accessories. Exemplary accessories include a keychain attachment, which may also act as a carrying case for different atomizers and small utilities, a wireless charging platform, a keychain holder for utility attachments and/or a magnetic USB charge, a phone case to hold additional attachments and/or utilities, a small-profile atomizer holder, such as a credit-card sized atomizer holder for storing pre-filled or disposable atomizers (i.e., for 3-9 atomizers or any other suitable amount), a small-profile battery pack holder, such as a credit-card sized battery pack for holding 1-2 additional battery pack. It should be noted that any additional suitable accessories are contemplated.

The vaporizer and its components, including the atomizer, battery pack, and airway, may be formed in a variety of colors, skins and finishes. Exemplary finishes include glossy and matte. Exemplary colors include, but are not limited to, silver, black, white, space grey, gold, rose or any other suitable color. Additional exemplary skins and finishes include a wood finish, custom engraving on the exterior, real metallic exterior, such as gold, silver or platinum, and unique or customized skins, such as those made to look like a credit card.

The vaporizer 100 and its components include numerous features and benefits. The modular atomizer 211 may provide for additional utility attachments, such as flashlights. In an embodiment, the atomizer 211 itself may be modified or customized, without need to modify the entire vaporizer.

The modular airway 203 and mouthpiece 207 allow for modification of the draw resistance based on the selected airway size. Thus, the vaporizer can be modified with a modular airway/mouthpiece component, that can be interchangeably plugged-in to increase or decrease draw resistance, based on the airway size. This further makes the airway module 203 more hygienic and easier to clean and replace. In another embodiment, the airway tube 205 may be replaced, and may be disposable. This allows for individuals to share a vaporizer (such as by renting or borrowing one) without the concern for spreading bacteria and/or genus.

The modular battery 219 allows for the user to increase the size and capacity of the battery to provide for longer "vaping" sessions and increased usage between charging sessions. Additionally, it allows users to scale down the battery size when a smaller, thinner battery profile is desired. Further, the modular battery 219 allows for keeping multiple battery packs, to allow for changing the battery without the need for charging. The use of a smaller profile (e.g., 2 millimeter thickness) battery pack 219 allows for carrying the vaporizer in a pants pocket, with additional battery packs being sufficiently sleek to carry in a wallet or pocket. The vaporizer 100, due to the use of a modular battery 219, may also be customized for various occasions. For example, a wireless charging battery 219 may be used when the user will be near wireless charging stations, whereas a solar-panel battery pack may be swapped in for use while on a camping trip. In another example, a larger capacity battery pack 219 may be attached when the user wishes to go on a long excursion, with limited access to charging capabilities.

The vaporizer, as disclosed herein, includes capabilities of both a small and large vaporizer. The vaporizer includes a form factor with a flat design, allowing for the use of small and modular batteries, while allowing the batteries to retain high energy density and capacity due to their large surface area.

The vaporizer is formed of a plurality of modules that are independently removable and interchangeable. These modules may be magnetic or include magnetic attachment mechanisms, providing for easy installation and removal.

Figure 3:
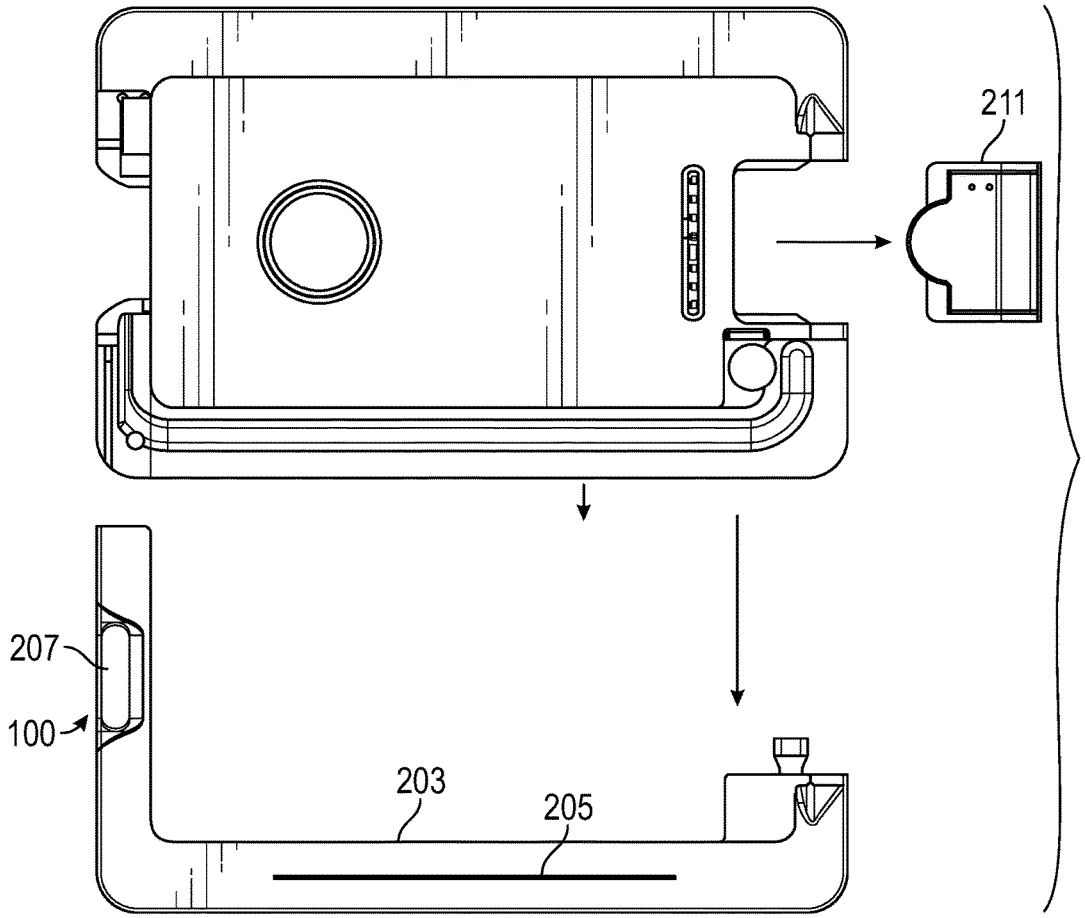

Referring now to FIG. 3, illustrated is an exemplary top-down exploded view of vaporizer 100. As shown, power button 201 is located toward a center portion of the vaporizer 100. Atomizer 211 is shown removable from the body of vaporizer 100. Airway module 203 includes air tube 205 and mouthpiece 207.

Figure 4:
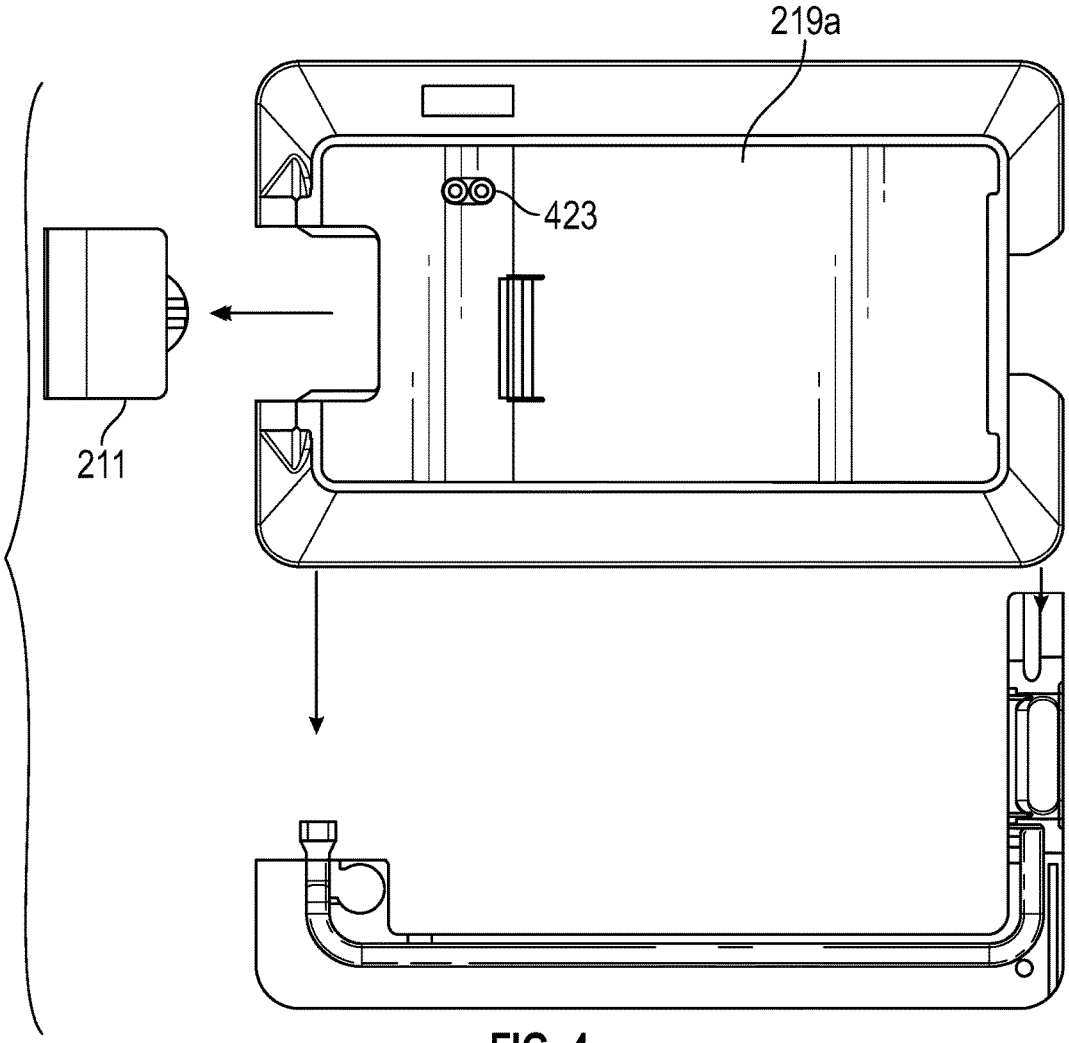

FIG. 4 illustrates an exemplary bottom-up exploded view of vaporizer 100. Atomizer 211 is shown removable from vaporizer 100. As illustrated a charging port 423 may be placed on the underside of the vaporizer 100, and is operable to receive a charging mechanism. In an embodiment, charging port 423 may be an alternative charge connection design to that of magnetic strip 221. Battery door 219*a* is configured to cover a compartment for the battery. Further illustrated is the removable airway module 203, with air tube 205.

Figure 5:
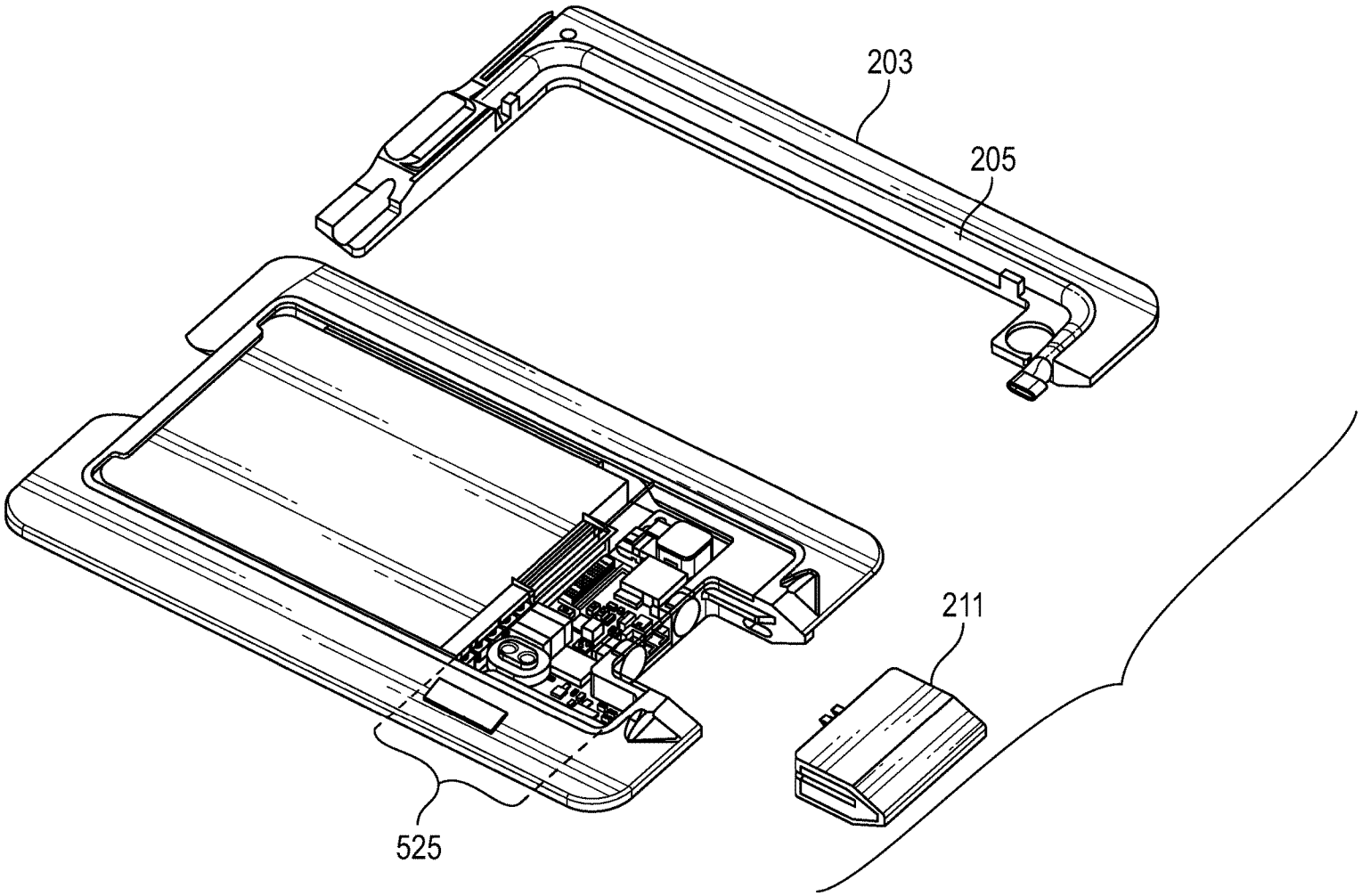

FIG. 5 illustrates another view of vaporizer 100, showing the charging port 423. Additionally, various electronic components 525, such as a microprocessor, CPU, memory, Bluetooth transmitter and receiver, WiFi transmitter and receiver, current controller, battery protection, and any other suitable components are shown. Airway module 203 is shown with the interior tube 205 exposed.

In accordance with one embodiment, vaporizer 100 includes improved devices and methods for heating plant matters, liquids, and concentrates of active ingredients to be vaporized. The components, as shown, are suitable for replacing and improving upon heating methods utilizing traditional resistive metal coils.

Figure 6:
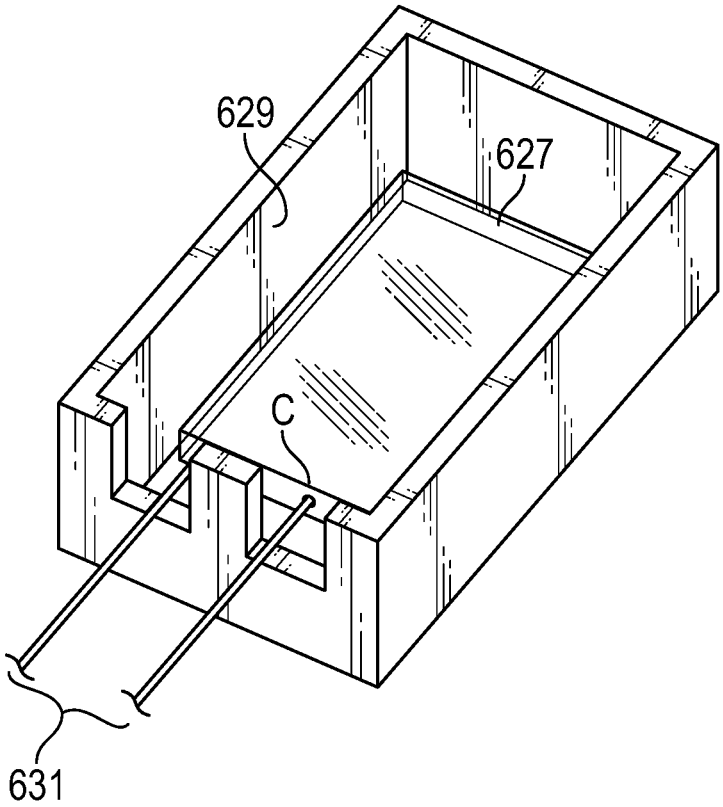
FIG. 6 illustrates an atomizer in accordance with the invention.

Atomizer 211, as disclosed herein, includes a glass heating element and a bowl assembly. Referring to FIG. 6, illustrated is an exemplary atomizer 211. Rectangular glass heating element 627 is disposed within a bowl 629. Bowl 629 may be formed of ceramic or pure glass. Lead wires 631 are connected to the glass heating element 627, and extending outwards from bowl 629. In one embodiment, the leads 631 are covered by glass solder or other suitable material, in order to protect material to be vaporized from the metal. An exemplary size of the glass heating element 627 in this embodiment may be 10 mm×5 mm×1.2 mm, or any suitable variations thereof.

One or more of the glass heating elements 627 are housed within or below the bowl 629, and vaporizable material, such as oils, are then inserted into the bowl 629. The material may be heated by running current through the glass heating element 627.

For use when conduction heat is desired (such as for dry-herb or loose-leaf material), glass heating element 627 encloses the material, and no other container is necessary. That is, the loose-leaf or dry-herb is inserted directly into a glass-tube heating element such as tubes 943, 945, and 947, shown FIG. 9, which maintains glass contact with the material.

When convection heating is desired, glass heating element 627 serves as a heater for the air, which passes through the material contained in a medical grade container, such as the bowl 629. The glass of the medical-grade container (though other types of containers, such as ceramic or stainless steel, are contemplated) may be formed in a honeycomb shape, such as honey-comb shaped glass heating elements 951, 953 or 955, shown in FIG. 9, and does not impart impurities.

In one embodiment, vaporizer 100 preferably includes an all-glass heating element 627, which is the only item in contact with the vaporizable material. In another embodiment, ceramic or other inert materials may be used as a suitable replacement and in an identical matter to glass heating element 627. It should be noted that, as discussed herein, the glass heating element may be used with any suitable vaporizer.

In accordance with one embodiment, the glass heating element 627 can be formed in varying shapes and forms. For example, depending on the heating method and type of vaporizer application, the shape and size of the heating element 627 can be formed to fit a particular size.

Glass heating element 627 may be suitable for conducting heat and reaching temperatures up to, and including, 900 degrees Fahrenheit, or any other suitable temperature.

Figure 7:
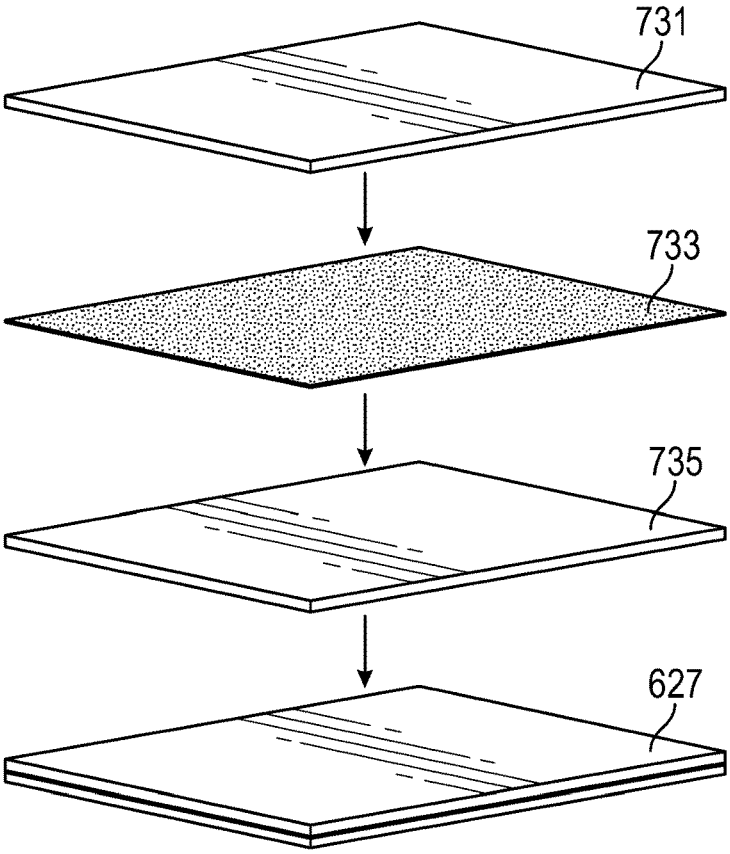
FIGS. 7-9 illustrate exemplary heating elements in accordance with the invention.

FIG. 7 illustrates an exemplary embodiment of the glass heating element 627. Heating element 627 includes top piece 731, middle coating 733, and bottom piece 735. Top piece 731 is located on the top of the heating element 627, and may be formed from any suitable material, such as, but not limited to, glass or quartz. Middle coating 733 is a coating or film, such as, for example, a thin metal film or a nano-coating, such as a nano-wire coating. In an embodiment, middle coating 733 may be a clear coating. Bottom piece 735 forms the bottom of heating element 627, and is formed of a suitable material such as quartz.

Thus, top piece 731 and bottom piece 735 form a sandwich around middle coating 733, with lead wires 631 connected thereto. Once properly placed, the top piece 731, middle coating 733 and bottom piece 735, along with lead wires 631, are sealed with high temperature glass solder around the edges, forming a complete glass heating element 627.

In one embodiment, middle coating 733 is vapor deposited onto the bottom piece 735, whereas in another embodiment, middle coating 733 is manufactured separately, on its own, as a solid layer, and is then deposited as melted liquid. The liquid of middle coating 733 may then be hardened or re-hardened using temperature or by adding a hardening agent, which may additionally be nano-deposited.

An exemplary process may be as follows: (1) a thin film or nano-coating 733 is applied onto the bottom piece 735; (2) an additional glass part, such as top piece 731, is placed on top of the nano-coating 733; (3) lead wires 631 are applied on the side of the glass of pieces 731 and 735, and coating 733; and (4) a glass solder is applied to attach the leads 631 and to combine the piece 731, coating 733, and bottom piece 735, which causes the metal to be covered with glass.

In accordance with these various processes, various embodiments and methods of connecting leads and wires to the glass heating element are contemplated.

In one embodiment, wires 631 are connected on the sides of the various glass components discussed above, before applying glass solder. That is, wires 631 are applied and then soldered with silver onto the glass. The silver solder is then covered with glass solder.

Figure 8:
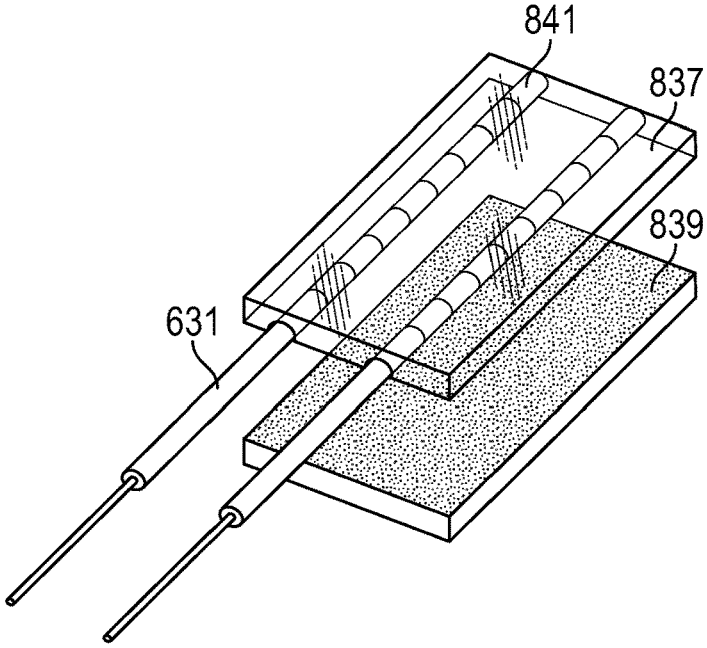

Referring now to FIG. 8, another embodiment of heating element 627 is provided. In accordance with one embodiment, a non-coated glass portion 837 includes indentations (also referred to as trenches) 841 on the surface. Wire leads 631 are inserted into trenches 841 before combining the non-coated glass 837 with the coated glass 839. Wire leads 631 are placed onto the side that will be in contact with the coated glass 839. Glass solder may then be applied around all edges, in order to seal the glass together. In accordance with the various embodiments, conventional high-temperature glass solder may be utilized.

Using the various heating element embodiments disclosed herein, metals or other impurities may be prevented from being exposed to, and contaminating, the item to be vaporized. That is, the glass heating element 627 is substantially non-reactive, and does not impart chemical or physical attributes onto the substance to be vaporized. Further, use of the aforementioned glass heating element 227 prevents fumes from being emitted, thereby providing for a pure vaporized flavor.

Figure 9:
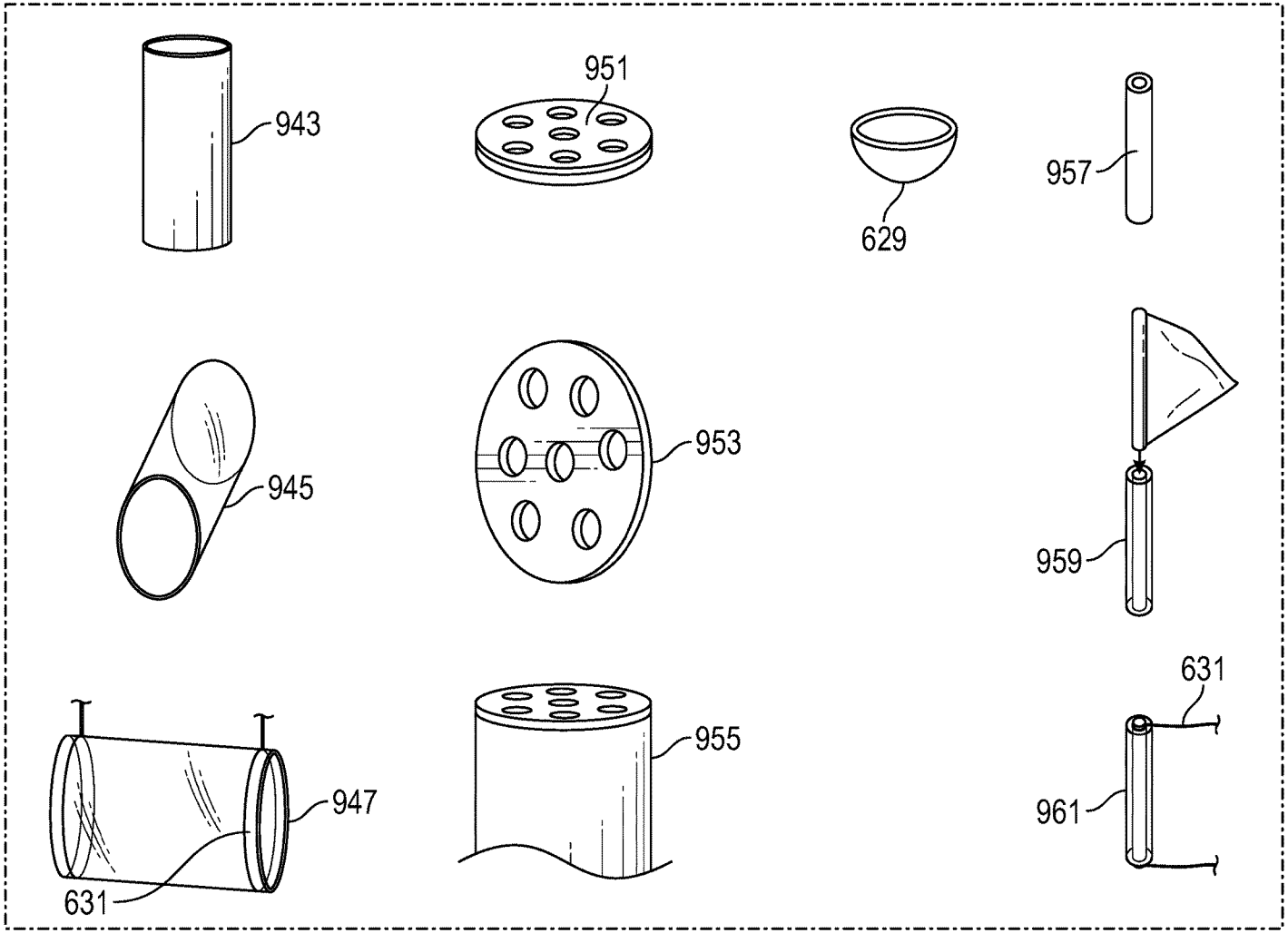

FIG. 9 illustrates various form factors for glass heating element 627 in accordance with various embodiments. Tubes 943, 945, 947 are various embodiments of tube shapes. The tubes are formed of a thin metal or nano-coating applied to the exterior of the tube. In some embodiments, the exterior coating may be surrounded by a secondary piece of glass. In one example, tubes 943, 945, 947 may be optimally suited for use with dry-herb applications, where heat will be conducted to the herb.

Tubes 943, 945, 947 include the thin film or nano-coating as a clear coating, which in turn does not obstruct the transparency of the heating element (that is, the tube). This provides for optimal viewing of the vaporizing of the substance.

In one embodiment, tube 947 illustrates contacts of lead wires 631 looping around the glass, providing equal distribution of the current throughout.

Another exemplary form factor includes honeycomb glass, which is shown as honeycombs 951, 953, and 955. The honeycombs include a circle with a plurality of holes, which are specially formed for convection heating. That is, the holes in the glass allow for air to pass through and heat up effectively. In an embodiment, the thin-film or nano-coating 733 is sandwiched between top piece 731 and bottom piece 735, and is then drilled. In another embodiment, the top piece 731 and bottom piece 735 are pre-drilled with holes before application of the coating.

Thus, the uses of honeycomb shaped glass heating elements are particularly suited for heating dry-herbs or loose-leaf using convection (e.g., air is heated prior to passing through the vaporized substance).

The glass heating element 627 may further be formed in the shape of a glass bowl 629. The glass bowl 629 is optimally suitable for oil concentrates heated through conductive heating. In this embodiment, glass is coated from the bottom of the glass bowl 629. The coating is then isolated from the air path, which prevents exposure of the coating to vapor and air to be inhaled by a user. Connection is then made to power and electronics via the outer portion of the heating element 627, so that no impurities contact the item to be vaporized.

Glass bowl 629 is optimally formed for use with oils since, upon being heated, the oils reduces viscosity and become more like standard liquids. Thus, glass bowl 629 for hot liquid oils to pool at the bottom of the bowl 629 during heating.

In one embodiment, the glass bowl 629 may be constructed from an ordinary glass bowl 629, which holds the desired substance, and a simple metal coil (not shown) may be used to heat the glass bowl, ultimately vaporizing the desired substance. However, this process would be imprecise and less effective than use of a metal layer within glass.

In yet another embodiment of the glass heating element 627, various glass cylinders 957, 959, and 961 are shown. Glass cylinder 961 is particularly suited for conductive use using a small coated glass cylinder with nano-metal coating. The coated cylinder is then inserted snuggly into the glass tube. Lead wires 631 are then applied, and everything is sealed together with glass solder on both sides.

Exemplary sizes for application of the glass heating elements include, but are not limited to, a 10 millimeter (mm)×5 mm×1-2 mm rectangle shape; a 10 mm-15 mm diameter and 1 mm-2 mm wall thickness tube; an 8 mm-15 mm diameter and 1 mm-5 mm thickness honeycomb disk; an 8 mm-20 mm diameter and 5 mm-10 mm depth bowl; or a 5 mm-15 mm length and 3 mm-7 mm diameter cylinder.

In accordance with one embodiment, glass heating element 627 may be completely clear, completely opaque, or semi-clear/semi-opaque.

Glass heating element 627 includes a conductive coating of nano-thickness disposed onto the glass, as discussed herein. The heating element 627 further includes one or more electrodes (not shown) disposed on the conductive coating. Thus, evenness of the conductive coating 733 and precise placement of lead wires 631 causes the conductive coating attributes to be stabilized, and uniform performance of heating element 627 at high temperatures. The resistive and/or conductive middle layer 733 (nano-coating or thin film layer) may be formed and applied using any metal that can be coated, doped, sputtered, evaporated, sintered or pressed into or onto the glass. For example, the metal may include, but is not limited to, indium tin dioxide, gold, AZO, or any other suitable metal. Additionally, patterning may be applied during the coating process.

The coating is applied to a substrate, including, but not limited to, quartz, clear ceramic, or any suitable type of glass, ceramic, crystal, or crystal-like substance. The resistance of the heating element is customizable, and can be catered to particular applications. An exemplary resistance range includes, but is not limited to, 0.5-10 ohms.

In order to retain a clear finish of the glass heating element, sputtering metals, nano wires, nano metal powder coating sintered into glass at high heat, thin film, or nano particle aqueous solutions coated onto the substrate may be used.

As discussed herein, advantages of an all-glass heating element 627 include elimination of metal impurities released into vapors or production of toxic fumes that would otherwise occur due to corroding and/or oxidizing of metals. Further, all-glass heating elements reduce the uneven heating temperatures produced by metal coils, which may otherwise cause burning of oils and release of unhealthy carcinogenic vapors and degradation of vapor flavors. Additionally, all-glass heating elements are more durable and energy efficient than resistive metal coils.

The glass heating element 627 coated with a thin film coating is therefore energy efficient and produces a prolonged battery life, with an even heat distributed to the vaporized substance. Using precise temperature controls over a given surface in combination with the glass, precise desirable levels of vapor can be obtained. Additionally, the glass heating element is non-carcinogenic, and non-corrosive, and produces a purer and more flavorful vapor without burning. Thus, in accordance with one embodiment, the glass forms a buffer between the vaporized substance and the heating coating, separating the vaporized substance from the radiant source of heat, thereby preventing burning and release of impurities or fumes. The glass further retains and maintains temperature for an extended period of time.

In accordance with one embodiment, the vaporizer 100 includes heating element 627, as discussed herein.

The vaporizer 100 may include additional embodiments, as discussed below. These embodiments may or may not include a glass heating element.

Figure 11:
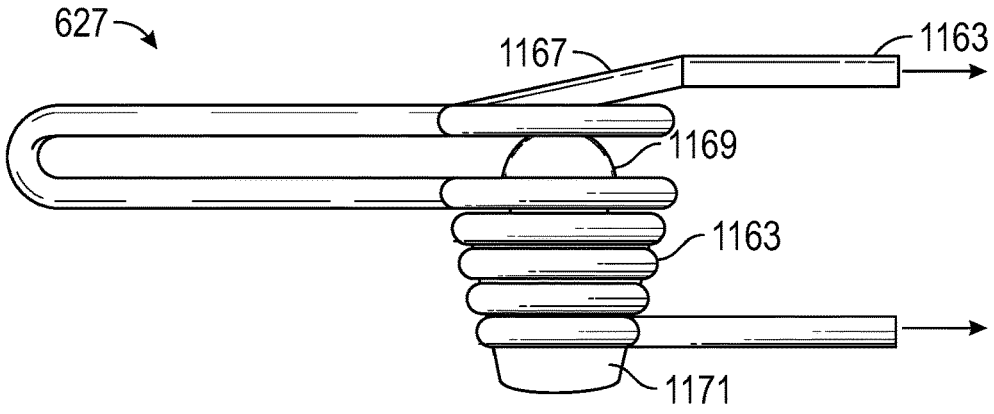
FIG. 11 illustrates an exemplary heating element in accordance with the invention.

In one embodiment, as illustrated in FIG. 11, levitation of the heating element 627 is achieved using induction heating (Eddy currents). Heating element 627 includes coil 1163. Coil 1163 creates an electromagnetic field, and is wrapped around a glass air-intake stem 1165, which is where a dab nail would otherwise be located. When the coil is turned on, the metal bowl located within the glass air-intake stem 1165 levitates and heats. Due to the Eddy currents.

In this embodiment, all external parts are cool to the touch. A hot nail sits inside at the top of the intake stem of the water pipe. The hot nail is therefore not directly exposed to the user, and the temperature control is precise.

Thus, as illustrated in FIG. 11, a bucking plate 1167 sits above levitated nickel and copper 1169. The helical coil 1163 may be any suitable number of turns, but is illustrated as a 4-turn helical coil. In on embodiment, the approximate diameter of the ceramic crucible 1171 at its base is 0.175 feet.

Vaporizers, such as vaporizer 100, are often associated with a dabber. In accordance with an embodiment, a dabber is disclosed. The dabber may be utilized with any of the features or variations disclosed herein.

Conventional dabbers are often placed on a surface when not in use, and therefore attract dust, debris, or other contaminants. Therefore, the dabber 1273, illustrated in FIG. 12, eliminates surface contact to reduce risk of contamination when not in use, increase purity, and provide for a convenient storage option.

Figure 12:
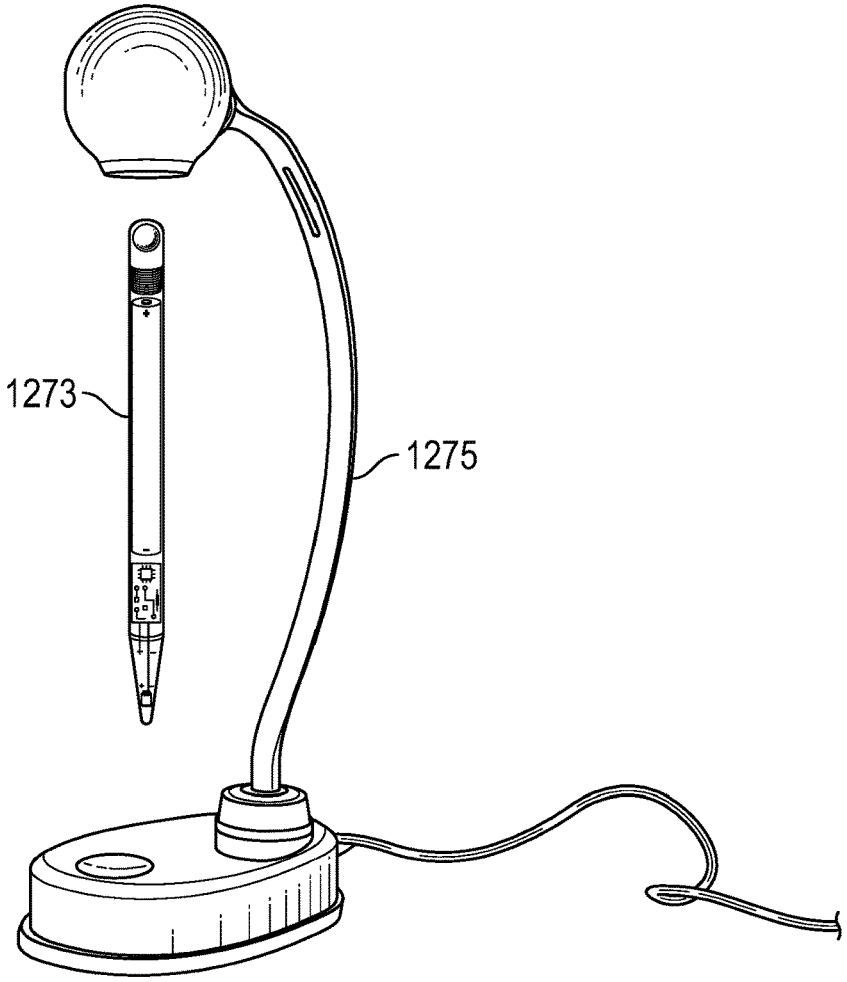
FIGS. 12-13 illustrate an exemplary dabber in accordance with the invention.

Referring now to FIG. 12, a levitating dabber 1273 is shown. The dabber 1273 incorporates electromagnetism to suspend from a small magnetic stand 1275. It should be noted that dabber 1273 and stand 1275, while used in conjunction with the vaporizer 100, are formed separately from the vaporizer 100.

Figure 13:
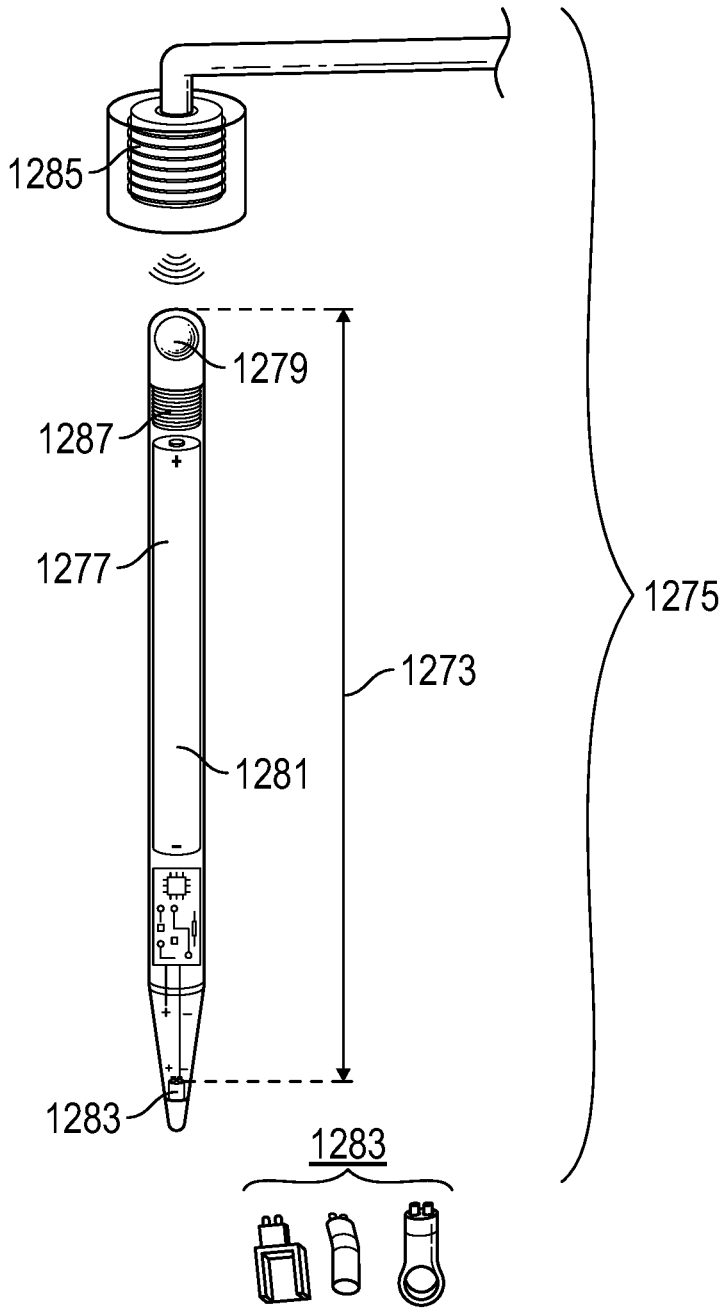

Referring now to FIG. 13, dabber 1273 includes a dabber body 1277. Dabber body 1277 houses a magnet 1279. Magnet 1279 may include any suitable magnet, such as, for example, a neodymium magnet, sufficient for suspending the dabber 1273 from the magnetic stand 1275. Dabber 1273 further includes a battery pack 1281, which may be in a thin cylindrical shape or any other suitable shape. Dabber 1273 also includes a ceramic heating element 1283, which may be located at a tip of the dabber 1273, or toward the center of the dabber.

Thus, the heated element 1283 provides ease of use in handling solid oil concentrates by providing heating contact with a solid. Further, the dabber 1273 may additionally function as a nectar collector, allowing a user to consume oil or concentrate directly from the dabber itself. In this embodiment, a straw-like attachment would be put into the dabber 1273, and would be flared around or next to the heating element 1283. The straw would lead to the top of dabber 1273, where the magnet 1279 is located.

As shown in FIG. 13, the levitating dabber system includes an electro-magnet 1285 located on stand 1275. The electro-magnet 1285 may be suspended from an arm of stand 1275. The dabber 1273 includes a magnet ball 1279 located at the top portion, or toward the top portion, of the dabber. One or more threads 1287 may be disposed below the magnet ball 1279. The threads 1287 are formed to allow the dabber 1273 to be opened, and the battery pack 1281 to be inserted and removed to within the body 1277 of the dabber. At the tip of dabber 1273, ceramic heater 1283 is shown as a tip for dabbing and providing heated contact.

Figure 14:
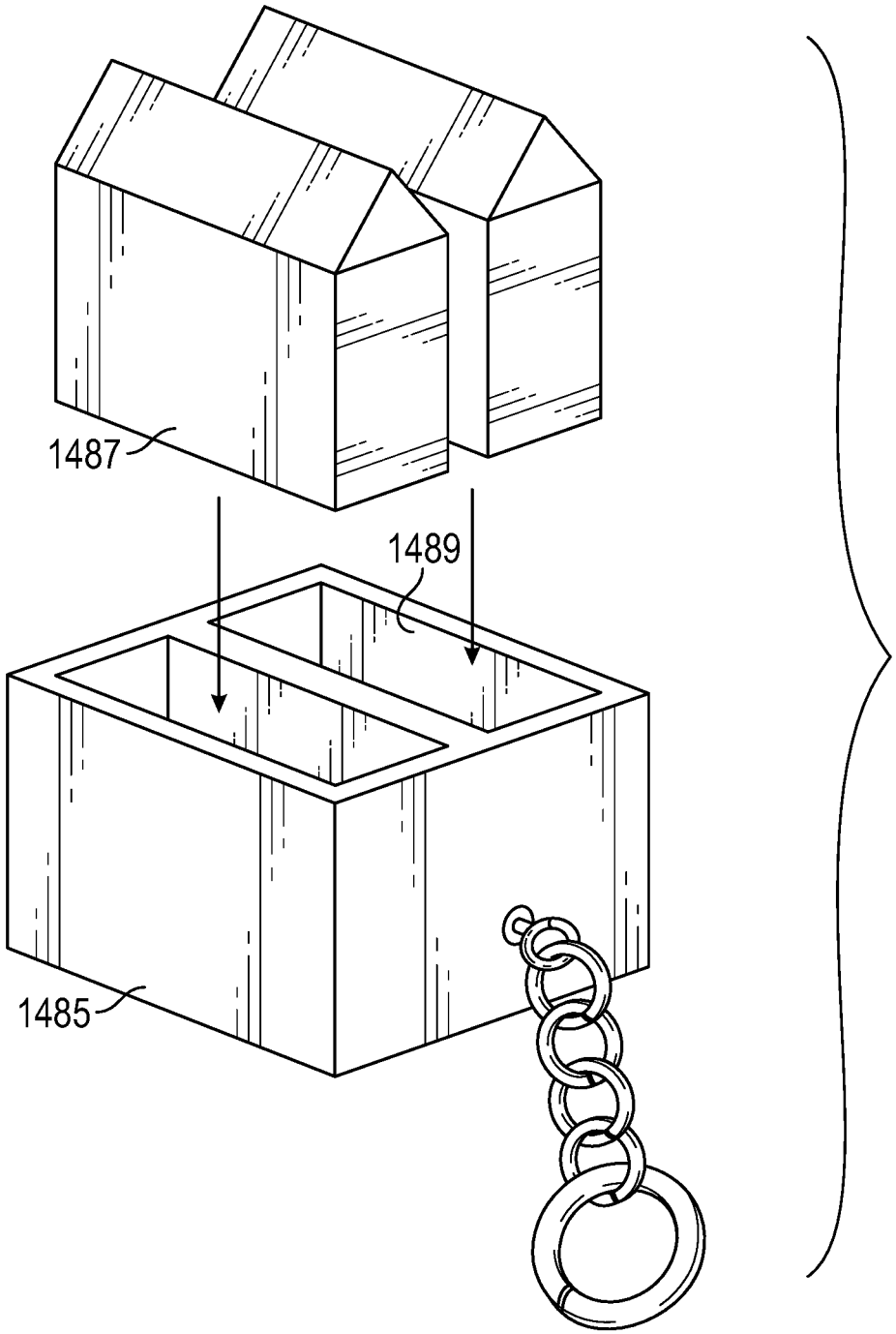
FIGS. 14-16 illustrate exemplary accessories to be with the vaporizer, in accordance with the invention.

FIG. 14 illustrates an accessory 1485 for use in an embodiment. Accessory 1485 may be a keychain or any variation thereof for holding spare atomizers or pods 1487 to be used with vaporizer 100. In another embodiment, the accessory 1485 may be formed as a card-sized holder, and may include capacity for any suitable number of atomizers or pods 1487. Thus, accessory 1485 may include one or more slots 1489, and each slot 1489 may hold one corresponding atomizer or pod 1487. Atomizer/pod 1487 may include some or all of the features of, or may be identical to, atomizer 211. In one example, the accessory 1485 includes four slots 1489, and in another example, the accessory 1485 includes six slots 1489, corresponding to space for six pods 1487.

Figure 15:
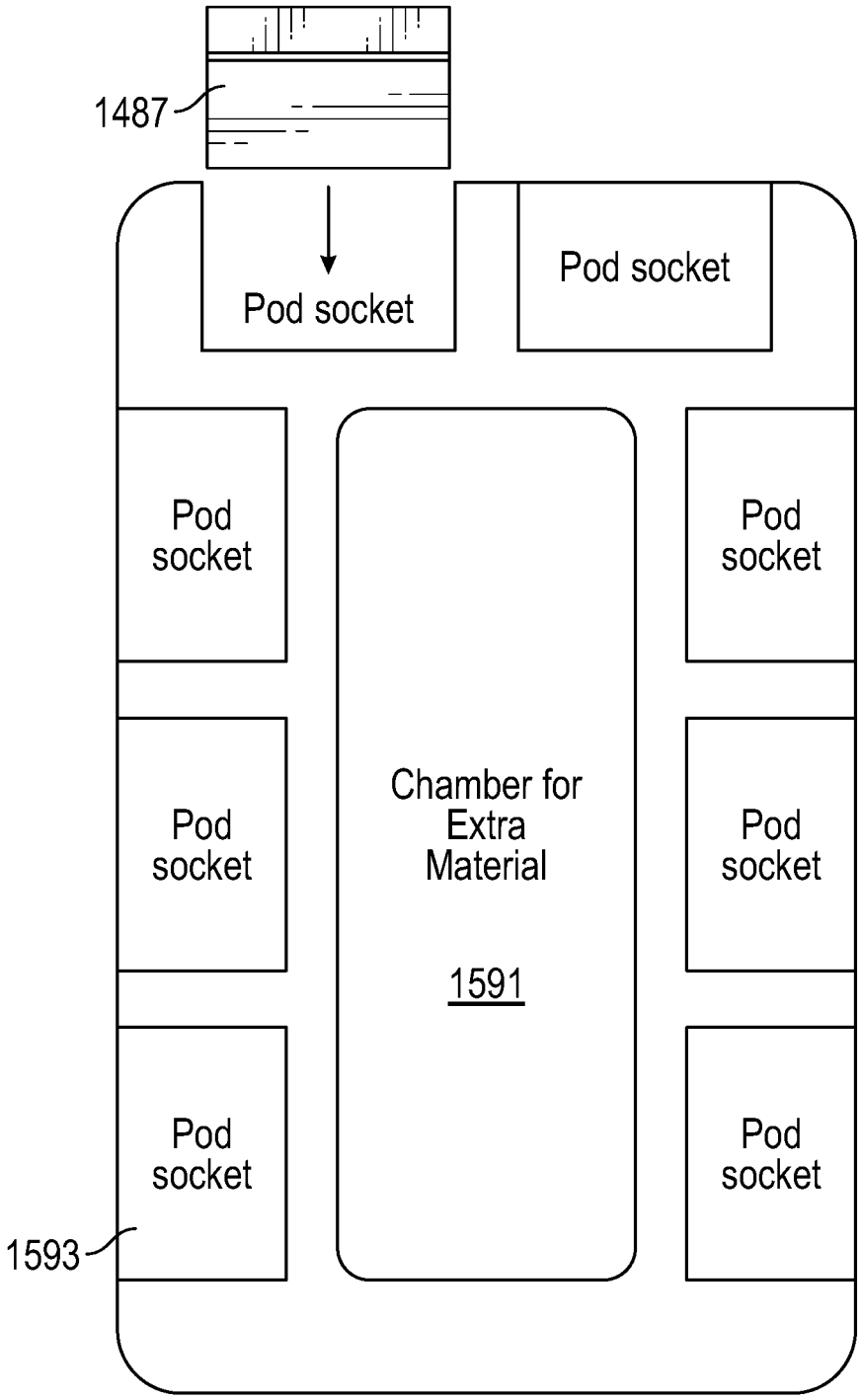

The slots 1487 may be formed as pod sockets 1593 in any suitable layout, such as that shown in FIG. 15. Accessory 1485 may further include a chamber 1591 for extra material to be stored.

Figure 16:
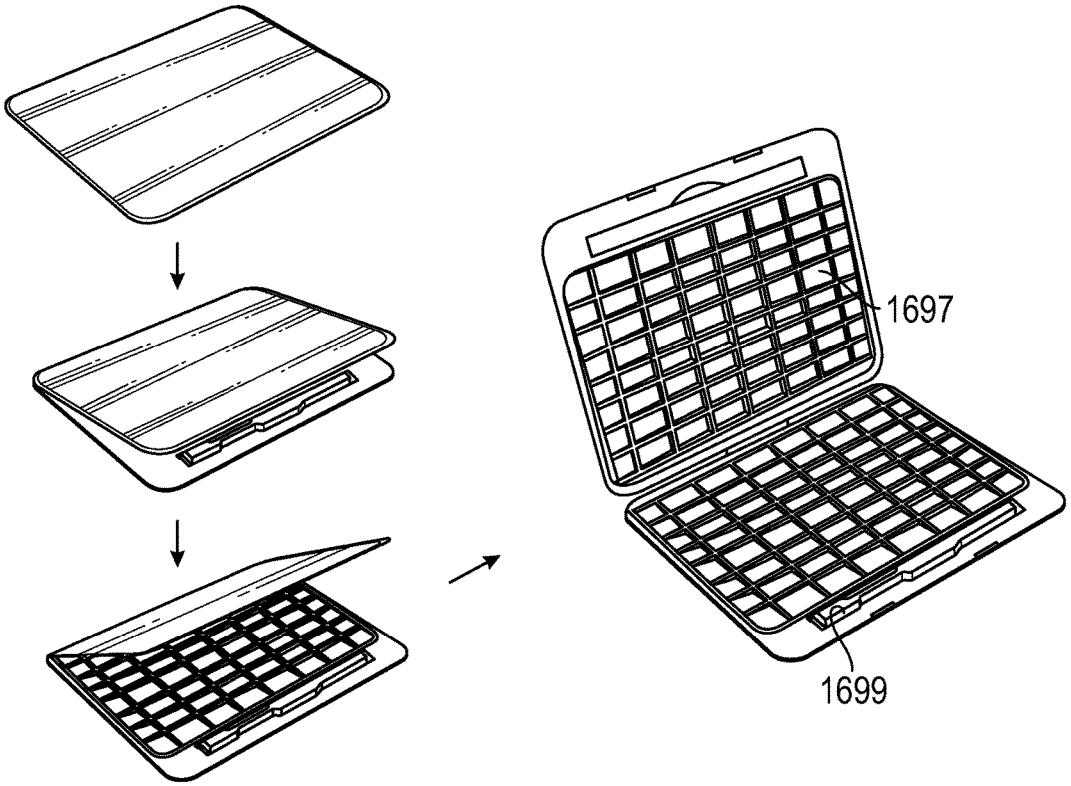

FIG. 16 clamshell card design 1695 that may be used in conjunction with the vaporizer 100. Card 1695 may be used to store solid oil concentrates, as well as a dabber tool.

Clamshell card design 1695 is illustrated in various configurations, such as closed, forming a smooth clamshell shape, a partially open position, semi-open position, and open position. The clamshell card may be lined with a non-stick silicone interior 1697, which is suitable for storing oils and other concentrates. Additionally, a slot 1699 may be formed integral with the interior of the clamshell, such as within the lower portion of the clamshell 1695. The slot 1699 provides a storage space for a dabber tool.

Figure 17A:
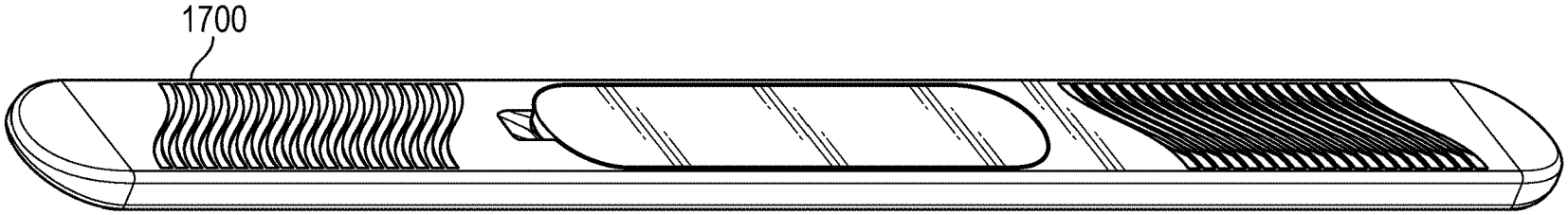
FIGS. 17A-17H illustrate an exemplary bracelet vaporizer, in accordance with the invention.
Figure 17B:
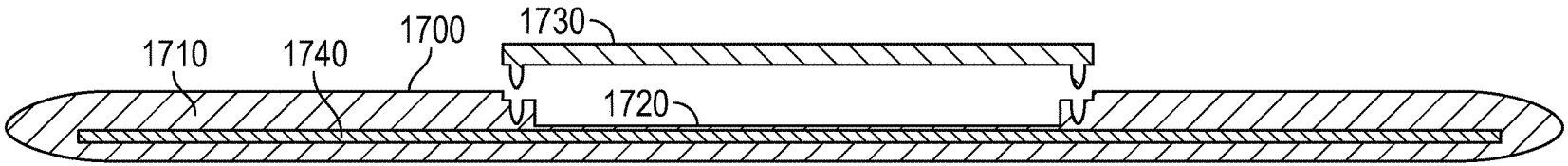

In accordance with an embodiment, bracelet 1700, illustrated in FIGS. 17A-17B may be utilized as an accessory for a vaporizer. The bracelet 1700 may include a storage system for storing solid oil concentrates or liquids.

Referring to FIG. 17B, as shown from a side, bracelet 1700 includes a silicone body 1710. Integrally formed with the body 1710, or in some embodiments, separately formed, is a cavity 1720 for receiving and/or storing oil concentrates, herbs, and liquids. On top of the cavity is a silicone lid 1730, which may be hinged on one side. The bracelet 1700 may further include a bent metal sheet 1740 to provide for rigidity. For example, the bracelet 1700 may include metal sheet 1740 to function similar to a slap-bracelet.

Figure 17C:
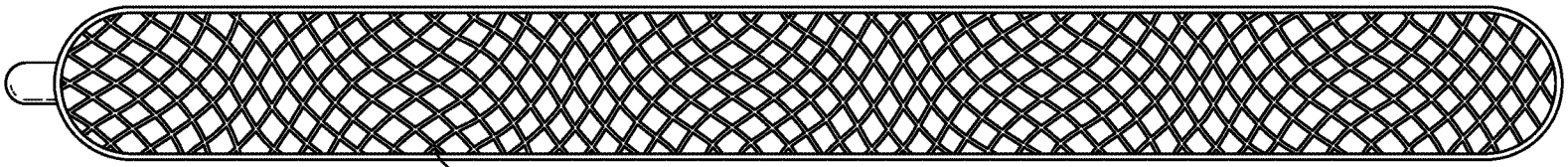
Figure 17D:
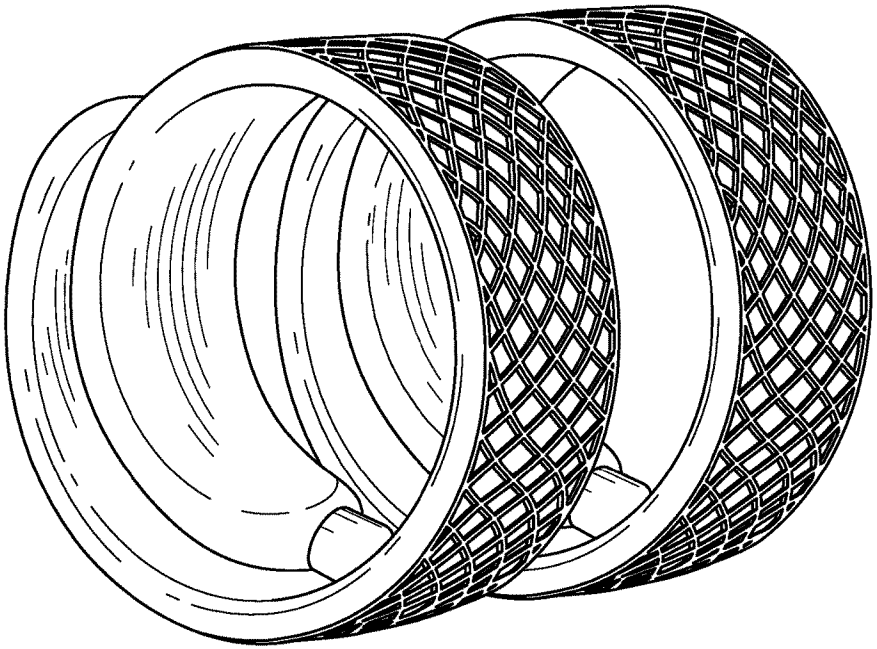
Figure 17E:
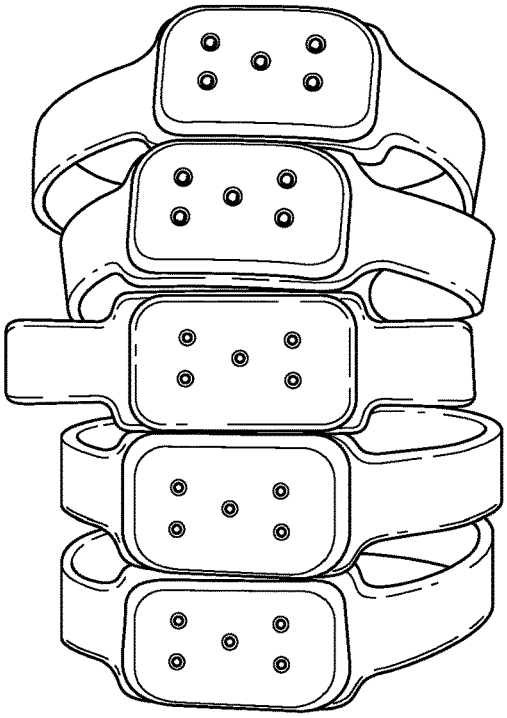
Figure 17F:
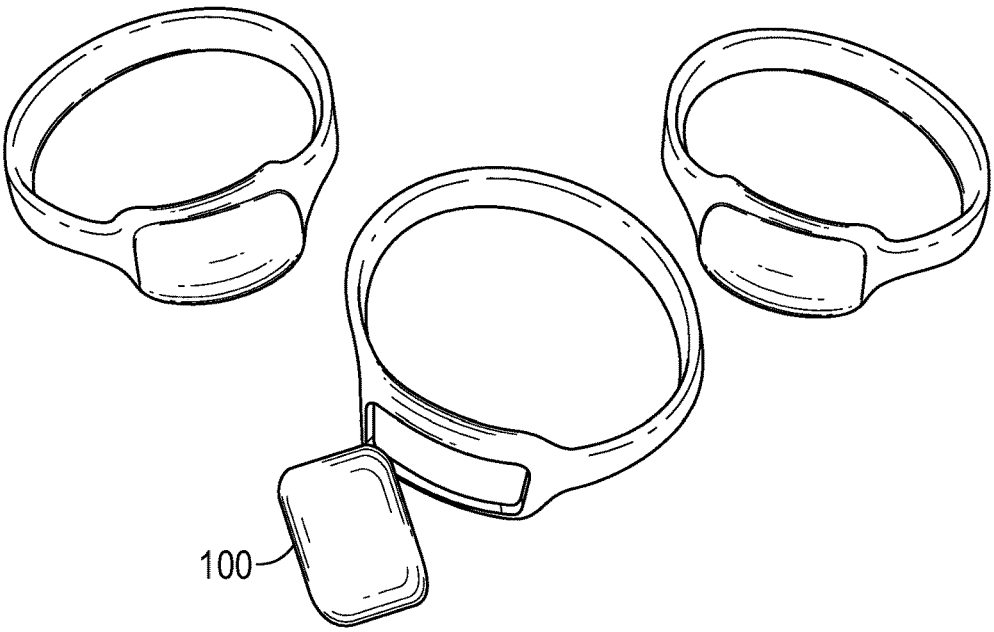

FIGS. 17C-17E illustrates various alternative embodiments of bracelet 1700, including those with textured silicone bodies and those with smooth silicone bodies. FIG. 17F illustrates an oil container bracelet with a removable lid 100. Additionally, as shown in FIGS. 17E-17F, the container bracelet 1700 may not include a metal sheet and may not snap onto the wrist, instead being pulled over the wrist.

Figure 17G:
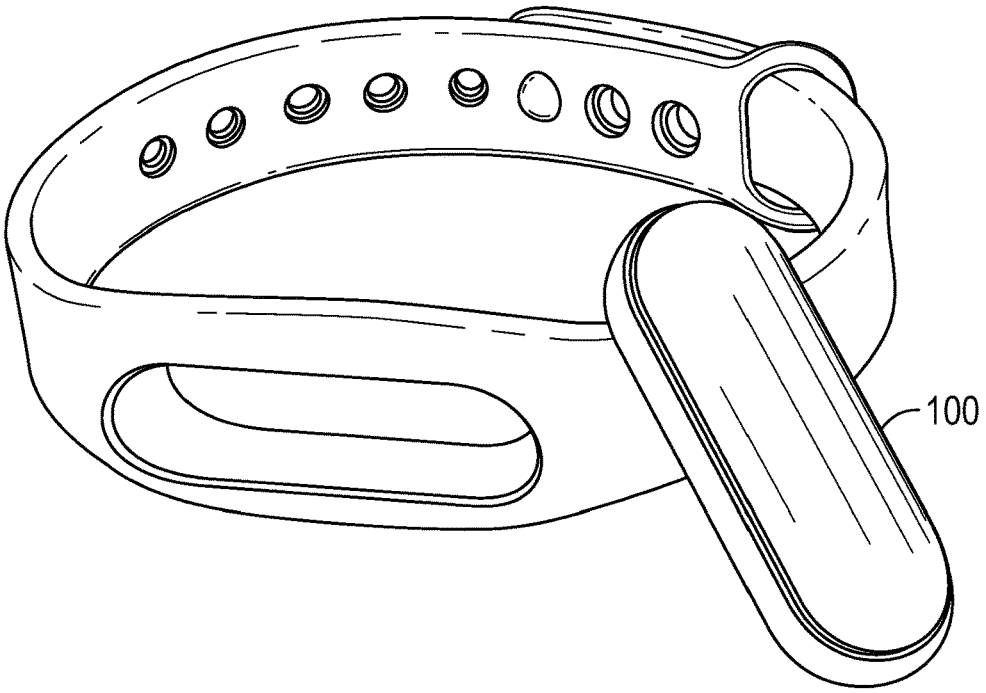
Figure 17H:
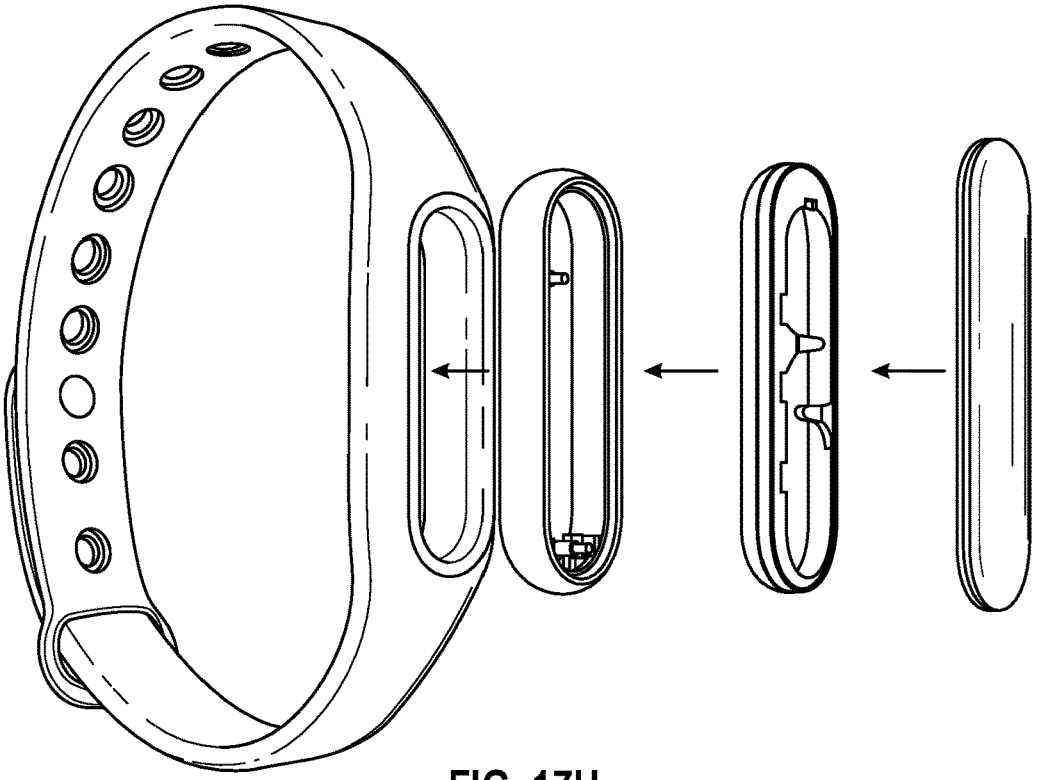

FIGS. 17G-17H illustrate bracelet 1700 with oil container 100. In an embodiment, oil container 100 may be interchangeable with a micro-vaporizer device.

Figure 18A:
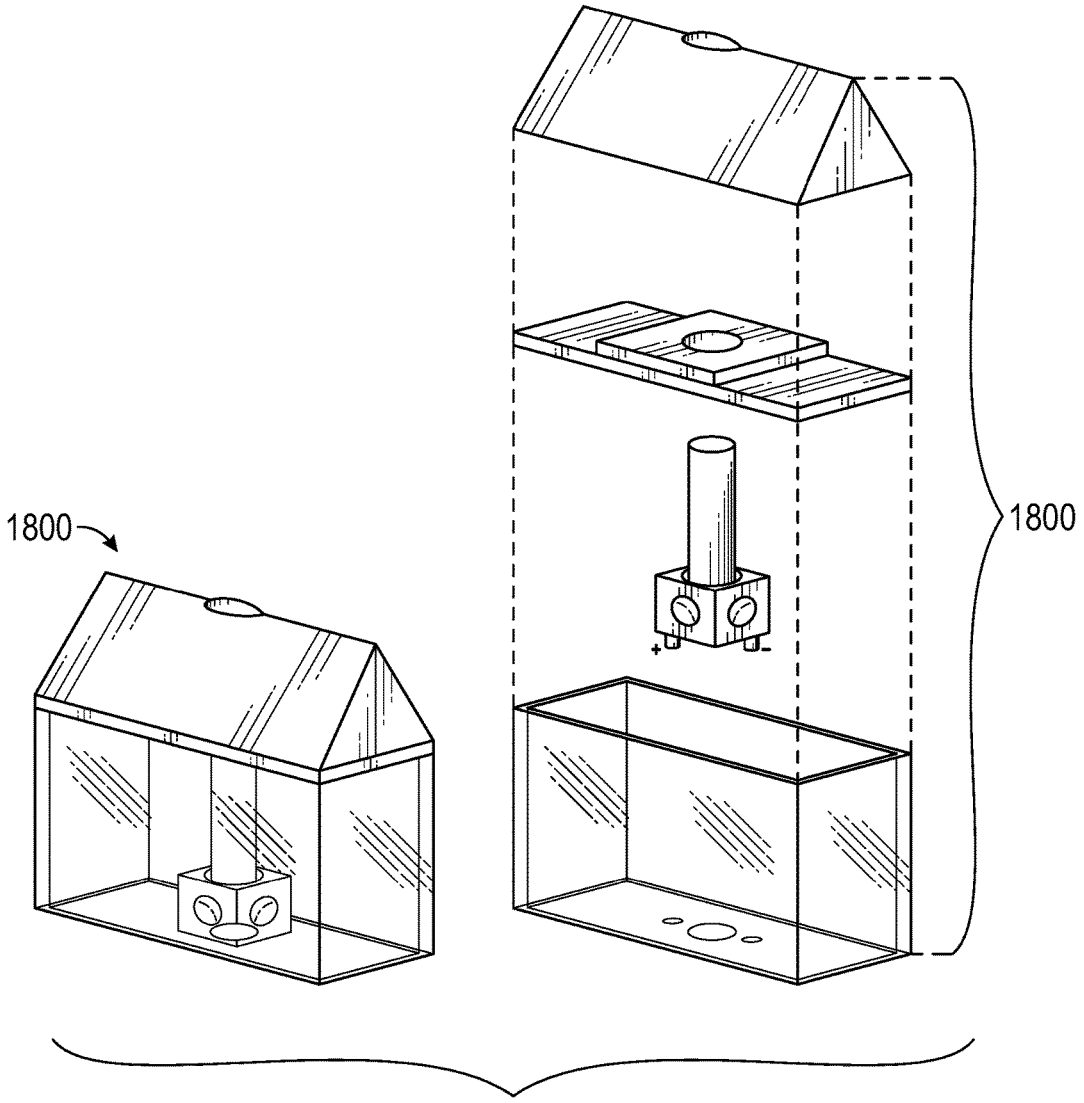
FIGS. 18A-18D illustrative atomizers in accordance with the invention.
Figure 18B:
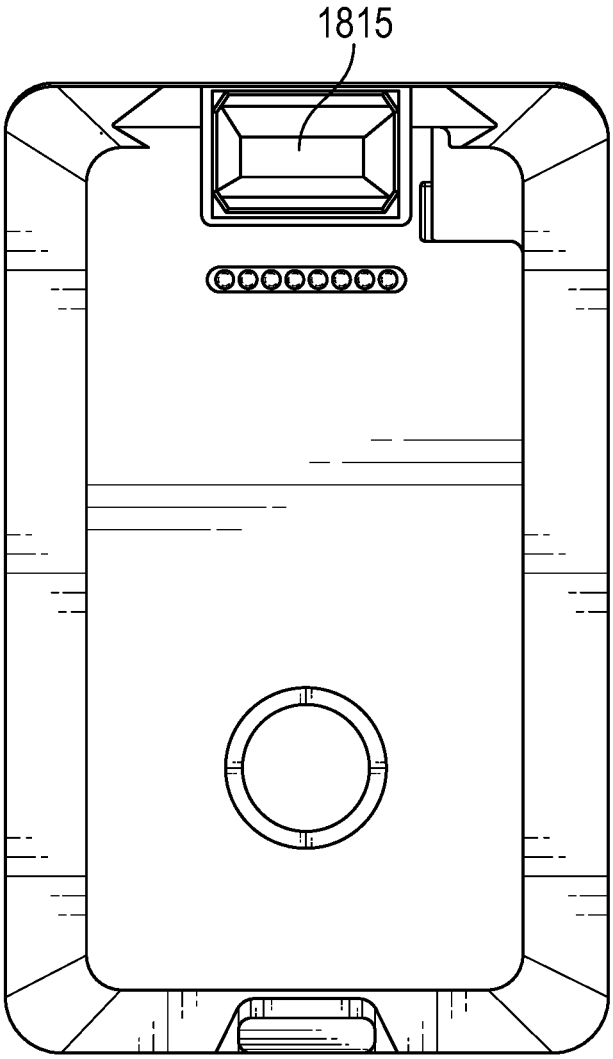

Referring to FIG. 18A, an embodiment further contemplates additional or alternative atomizers or ovens, such as e-liquid atomizer pod 1800 to be used with the vaporizer 100. Atomizer 1800 includes some or all of the features of atomizer 211. In some embodiments, atomizer 211 of vaporizer 100 may be formed to accept an e-liquid atomizer pod 1800. Thus, atomizer 1800 may be specifically formed to be used for e-liquid, and may be replaceable or interchangeably used with atomizer 211.

As shown in FIG. 18A, the design of the e-liquid atomizer pod 1800 incorporates a wicking system that allows for vapor to be wicked to the heating area/element 1805, while maintaining airflow. It should be noted that the heating area 1805 may include some or all of the features of heating area 627, and may be identical to heating area 627. In one embodiment, the atomizer pod 1800 may be configured to contain 0.5-0.7 milliliter of e-liquid. In other embodiments, the atomizer pod 1800 may contain any suitable amount, such as 0.1 mL or 2 mL of e-liquid.

Referring again to FIG. 18A, illustrated is an exemplary exploded view of the atomizer 1800. FIG. 18D illustrates the vaporizer 100, with the atomizer removed from the body.

Figure 10:
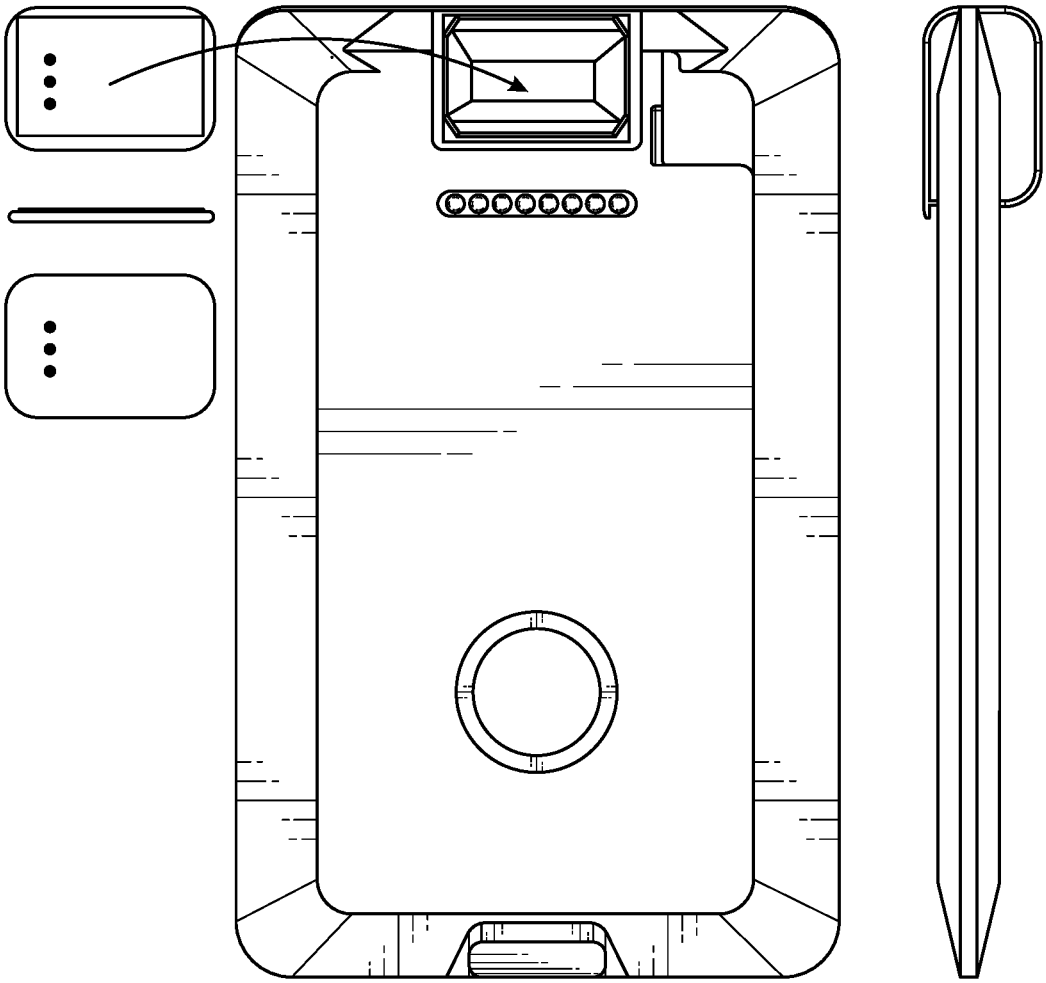
FIG. 10 illustrates an exemplary vaporizer with a removable atomizer in accordance with the invention.
Figure 18C:
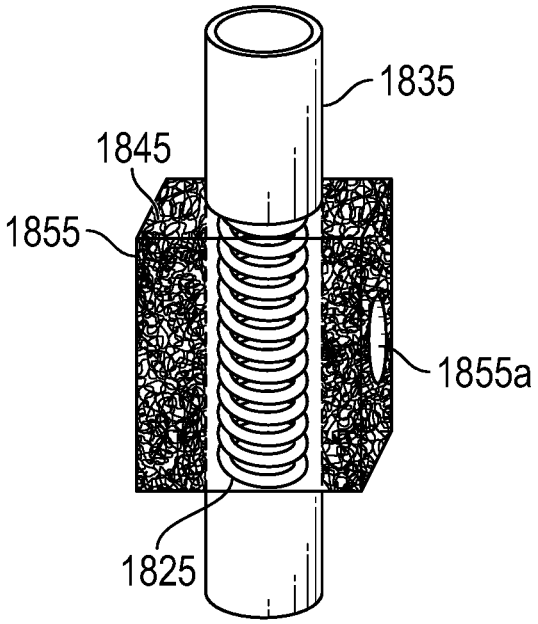
Figure 18D:
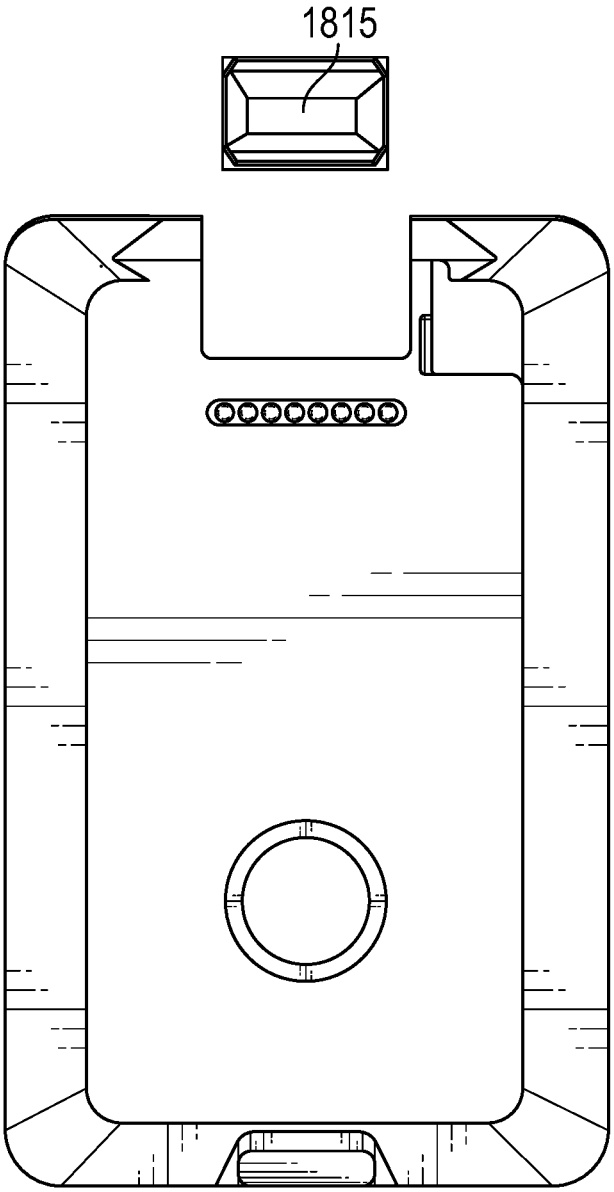

Referring now to FIG. 18C, the atomizer 1800 includes a coil 1825 surrounding a metal tube 1835, with the coil 1825 encased in cotton 1845 for wicks. Cotton 1845 and coil 1825 are housed in a metal casing 1855, with a hole 1855*a* provided within the metal casing. Hole 1855*a* allows for the e-liquid to soak into the cotton 1845, which surrounds the heating element. As shown, air flows into the metal tube 1835 and exits as vapor flow. Referring now to FIG. 10, illustrated is a top-down view of the atomizer 1800 inserted into the vaporizer, 100.

Figure 19:
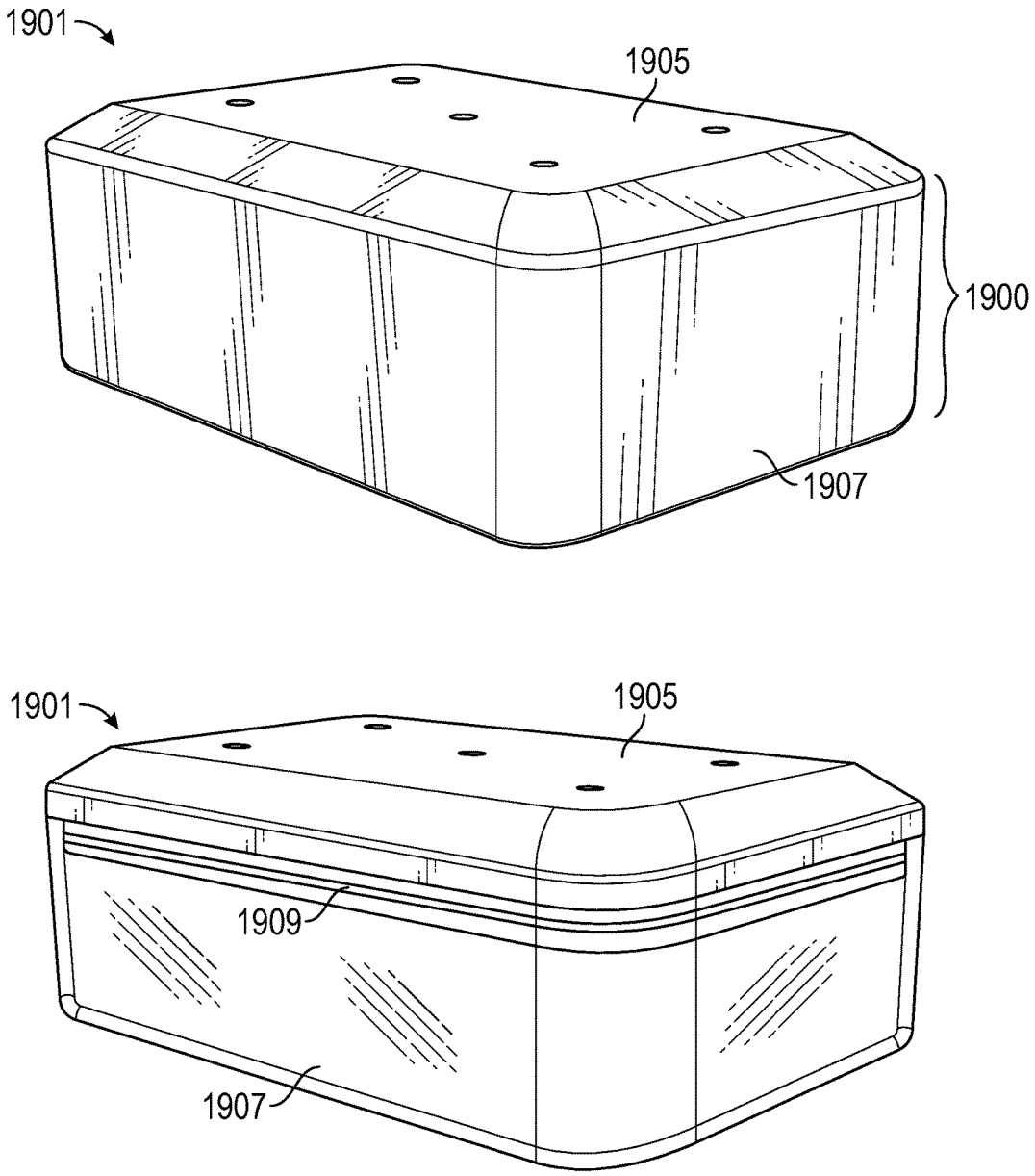
FIG. 19 illustrates an exemplary heating element in accordance with the invention.

FIG. 19 illustrates a bowl assembly 1901 for use with the vaporizer 100. Atomizer 1901 may also be an oven or pod. Atomizer 1901 is particularly suited for a vaporizer 100 formed in a credit-card form factor, and operates by conduction-style heating, where the dry herb is in direct contact with a hot surface.

The atomizer 1901 may be formed from zirconia ceramic, which due to its strength and durability, provides for favorable dissipation of heat. Atomizer 1901 may be formed with a body 1903, which in turn includes two ceramic zirconia parts: bowl 1907 and lid 1905. Lid 1905 is completely separate and removable from bowl 1907. However, using a silicone gasket O-ring 1909 disposed on either the interior of the bowl 1907 or the underside of lid 1905, an air-tight seal is formed, as shown in FIG. 19. It should be noted that some or all of the features of atomizer 1900 and its associated components may be identical to those of atomizer 211. Atomizer 1901 may include one or more grooves on its side to allow the atomizer 1901 to slide securely into the body of vaporizer 100.

Figure 20A:
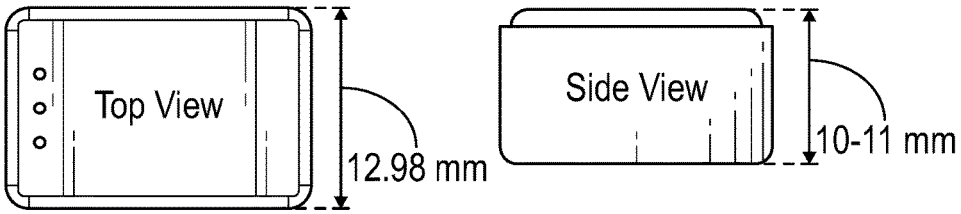
FIGS. 20A-20D, 21A-21D and 22A-22C illustrate exemplary atomizers in accordance with the invention.

Referring now to FIGS. 20A-20D, shown is another embodiment of the removable oven/conduction pod, forming a portion of atomizer 211. FIGS. 20A-20D are a continuation of the atomizer illustrated in FIG. 19. Referring to FIG. 20A, a top and side view, as well as accompanying exemplary measurements, are shown for the pod 1800.

Figure 20B:
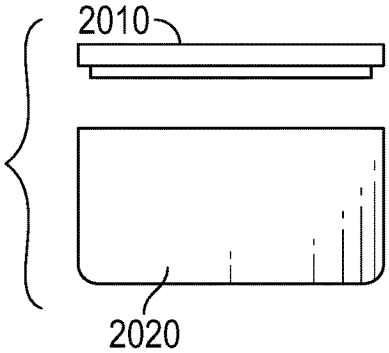
Figure 20C:
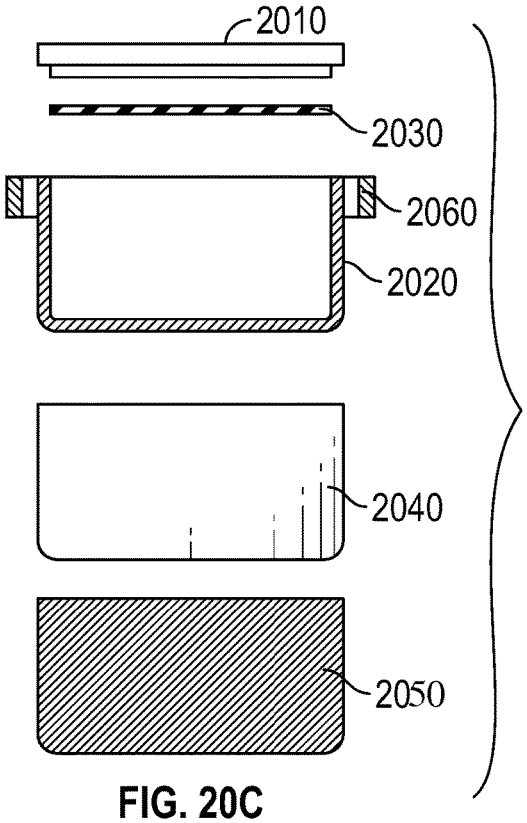
Figure 20D:
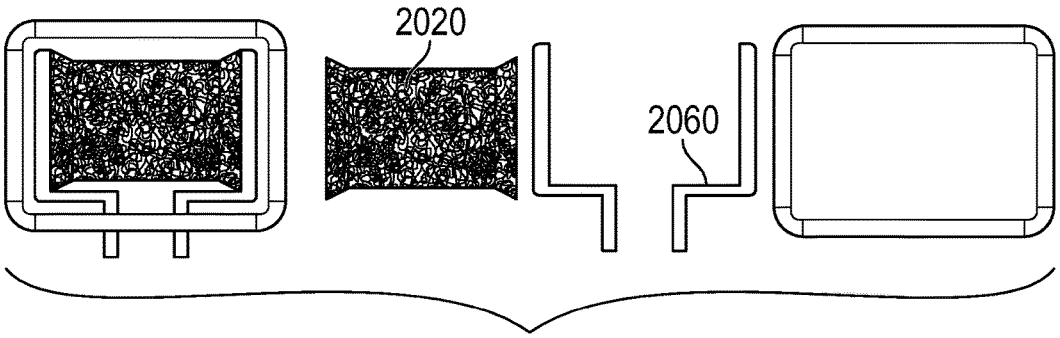

FIG. 20B illustrates a side view of lid 2010 and bowl 2020. FIG. 20C illustrates components ceramic lid 2010, silicone O-ring 2030, brass bus bars 2060, mesh heating element 2020, ceramic bowl 2040, and silicone insulation 2050. FIG. 20D illustrates a top-down view of an open pod 211, with a mesh heating element 2020 in the interior, and bus bars 2060 extending outward.

Figure 21A:
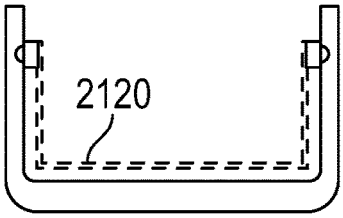
Figure 21B:
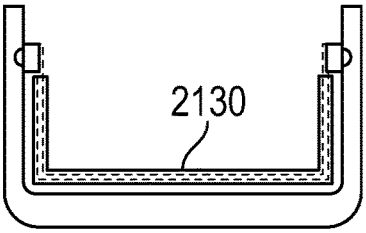
Figure 21C:
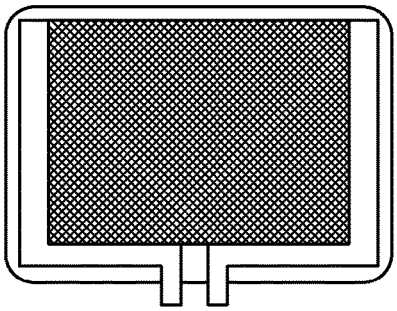
Figure 21D:
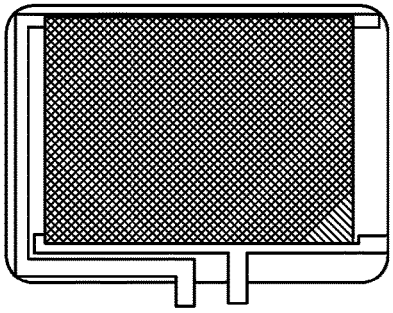

FIGS. 21A-21D illustrate another embodiment alternative heating element configuration for a heating element. The heating element may be formed of mesh 2120, shown in FIG. 21A. Alternatively, the heating element may be formed of stainless steel or titanium 2130, shown in FIG. 21B. FIGS. 21C-21D illustrate top bisected views of FIGS. 23A and 23B, respectively.

Figure 22A:
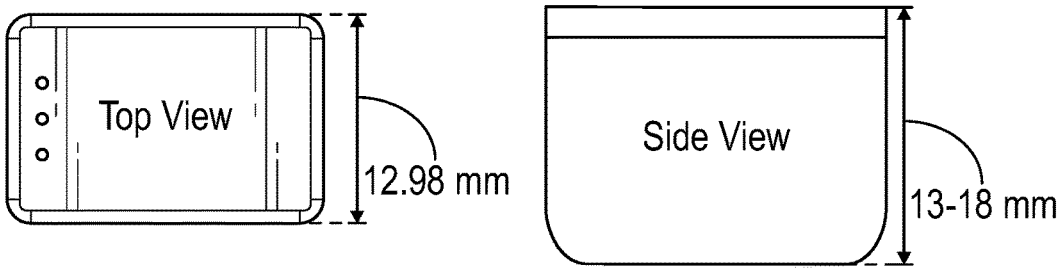
Figure 22B:
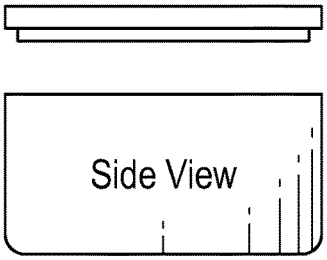
Figure 22C:
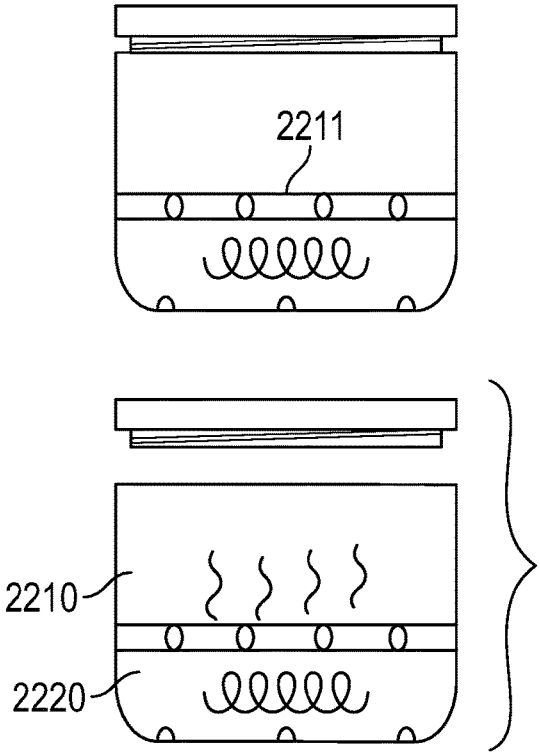

FIGS. 22A-22C illustrate another atomizer or oven to be used with a credit-card form vaporizer 100. The atomizer may include some or all of the features of any of the other embodiments discussed herein. The atomizer may utilize convection heating, and may be removably interchanged with any other suitable atomizer.

Referring to FIG. 22A, illustrated is a top and side view of the convection oven type with exemplary measurements. In FIG. 22B, a side view of an atomizer is shown, and in FIG. 22C, a bisected view of the atomizer is illustrated with a herb vaporization chamber 2210 and heating element chamber 2220.

Figure 23:
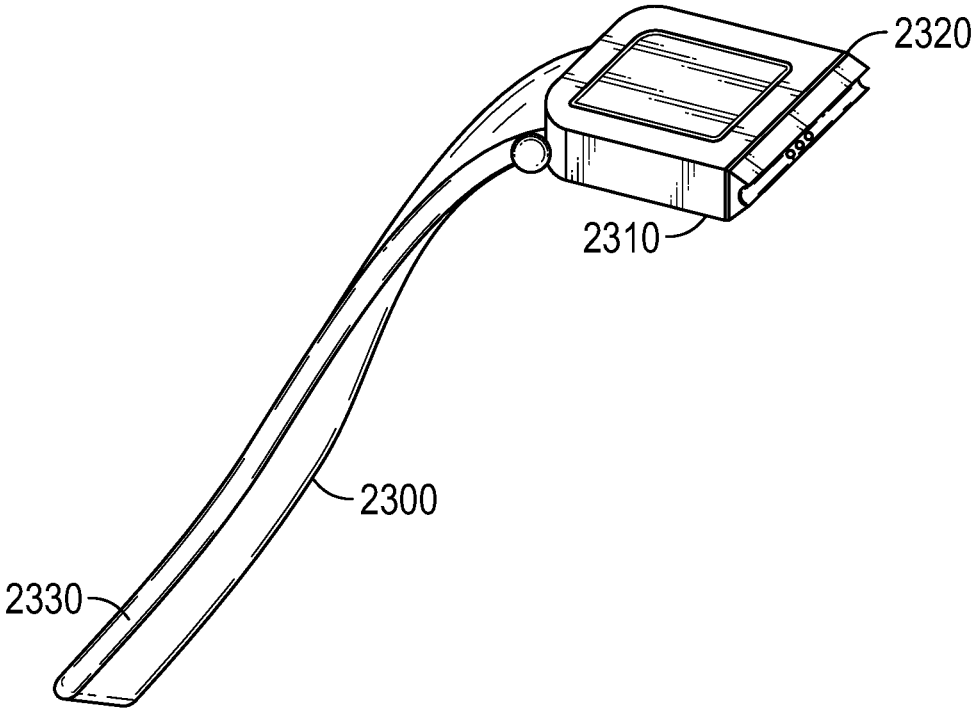
FIG. 23 illustrates an exemplary bracelet vaporizer in accordance with the invention.

In yet an additional embodiment, illustrated in FIG. 23, a bracelet vaporizer 2300 may be formed, incorporating some or all of the features as disclosed herein. In one embodiment, the bracelet vaporizer 2300 is thin and flexible, and may be formed of puncture-proof material, or material that will not permanently bend or rip. The battery may be flexible and located within the band. The battery is stable and not volatile, such that it will not combust or explode if punctured, ripped or cut. In another embodiment, at least a portion of the bracelet vaporizer 2300 may be rigid, such as the battery storage area and/or fan area. The housing 2310 of vaporizer 2300 may contain circuitry and an atomizing heating chamber, and incorporate some or all of the features as discussed herein. The housing further includes a mouthpiece 2320, which clicks into the housing and is removable. The mouthpiece 2320 includes a groove or slot for the band to attach, which fastens the bracelet vaporizer around the wrist. The housing further includes a flexible battery 2330.

Additional embodiments of the vaporizer may include features as discussed below, in order to integrate seamlessly into the lives of users, and to increase convenience, portability, and usability. Thus, the vaporizer 100 and associated accessories and variations thereof provide for convenience and compactness for use in multiple forms and settings.

Exemplary accessories to be used with the vaporizer 100 include a credit card sized oil container, an oil container key chain; an oil mini-syringe key chain, a bracelet oil container, a phone case to hold the vaporizer 100 and additional pods or atomizers, a pod holder card, a pod holder keychain, a wallet with a secret storage compartment, a pipe vaporizer, a cooling platform, a magnetic mixer (such as a bong mixer, water tornado, or scrubbing brush), a laser vaporizer, and an electronic oil dispenser pen.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

What is claimed is:

1. A modular vaporizer, comprising: an airway module;

an atomizer including a bowl assembly and an integrated glass heating element, wherein the heating element is formed from glass;

a temperature control mechanism; and a battery pack, wherein the shape of the vaporizer is formed with a flattened top and bottom surfaces, each surface measuring about a credit card size, and a plurality of beveled edges sloping downward from the top and bottom surfaces so that the vaporizer is higher than 1.5 mm-4 mm from the top to the bottom surface, at least one beveled edge comprising a notch, wherein the atomizer is formed to fit into the at least one notch, such that it can fit into a wallet or non-obtrusively slim into a pocket; and wherein the airway module is formed as the beveled edge of the vaporizer and is removable.

2. The vaporizer of claim 1, wherein the glass heating element is disposed within the bowl assembly, the vaporizer further comprising:

at least one lead wire connected to the glass heating element; and glass solder protectively covering the at least one lead wire.

3. The vaporizer of claim 1 further comprising a power switch, the power switch providing tactile feedback.

4. The vaporizer of claim 1, wherein the glass heating element includes a top piece, a middle coating, and a bottom piece.

5. The vaporizer of claim 4, wherein the top piece is formed from glass, the middle coating is nano-coated, and the bottom piece is formed of quartz.

6. The vaporizer of claim 5, wherein the top piece, middle coating, and bottom piece are stacked upon each and sealed with high temperature glass solder around the edges.

7. The vaporizer of claim 1, wherein the atomizer is configured for convection-type heating.

8. The vaporizer of claim 1, wherein the atomizer is configured for conduction-type heating.

9. The vaporizer of claim 1, wherein the glass heating element is formed in a 10 mm×5 mm×1 mm rectangular shape.

10. The vaporizer of claim 1, wherein the glass heating element is formed in an 8 mm-15 mm diameter and 1 mm-5 mm thick honeycomb-shaped disk.

11. A modular vaporizer, comprising:

a body assembly;

an airway assembly attachable by magnetic force;

an atomizer assembly attachable by magnetic force;

a temperature control mechanism;

a removable battery pack; and wherein the shape of the vaporizer is formed with a flattened top and bottom surfaces, each surface measuring about a credit card size, and a plurality of beveled edges sloping downward from the top and bottom surfaces so that the vaporizer is higher than 1.5 mm-4 mm from the top to the bottom surface, at least one beveled edge comprising a notch, wherein the atomizer is formed to fit into the at least one notch, such that it can fit into a wallet or non-obtrusively slim into a pocket; and wherein the airway module is formed as the beveled edge of the vaporizer.

12. The modular vaporizer of claim 11, wherein the airway assembly includes a mouthpiece and an exit port, the mouthpiece being removably attached.

13. The modular vaporizer of claim 12, wherein the heating element is removable, such that another heating element may be interchanged with the heating element.

14. The modular vaporizer of claim 13, wherein the heating element is a first heating element for conduction-type heating, the vaporizer further comprising a second heating element for convection-type heating that is interchangeable with the first heating element.

* * * * *